US010737897B2

(12) United States Patent
Kondo et al.

(10) Patent No.: US 10,737,897 B2
(45) Date of Patent: Aug. 11, 2020

(54) MEDIUM DISCHARGING DEVICE AND METHOD OF CONTROLLING MEDIUM DISCHARGING DEVICE

(71) Applicant: SEIKO EPSON CORPORATION, Tokyo (JP)

(72) Inventors: Katsuyuki Kondo, Shiojiri (JP); Masayoshi Miyakawa, Suwa (JP); Katsumi Okamoto, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/210,685

(22) Filed: Dec. 5, 2018

(65) Prior Publication Data

US 2019/0177107 A1 Jun. 13, 2019

(30) Foreign Application Priority Data

Dec. 7, 2017 (JP) ..... 2017-235470

(51) Int. Cl.
*B65H 31/10* (2006.01)
*B65H 29/38* (2006.01)
(Continued)

(52) U.S. Cl.
CPC ..... *B65H 31/10* (2013.01); *B65H 29/34* (2013.01); *B65H 29/38* (2013.01); *B65H 29/52* (2013.01);
(Continued)

(58) Field of Classification Search
CPC .... B65H 31/10; B65H 31/3018; B65H 29/38; B65H 29/34; B65H 2404/693
See application file for complete search history.

(56) References Cited

U.S. PATENT DOCUMENTS 4,844,633 A * 7/1989 Greenberg ..... B41J 13/106 400/625
5,745,141 A * 4/1998 Miyawaki ..... B41J 13/10 271/278
(Continued)

FOREIGN PATENT DOCUMENTS

CN 102372183 A 3/2012
JP 2002-104705 A 4/2002
(Continued)

OTHER PUBLICATIONS

Extended European Search Report issued in Application No. 18210939 dated Apr. 18, 2019.

*Primary Examiner* — Patrick Cicchino
(74) *Attorney, Agent, or Firm* — Workman Nydegger

(57) ABSTRACT

A medium discharging device includes a discharge roller pair that discharges a medium, a discharge tray disposed below the discharge roller pair in a vertical direction and having a placement surface on which the discharged medium is placed, and a guide member that is advanced and retracted between an advanced position where the guide member is advanced inward in a width direction from opposite sides in the width direction intersecting a discharge direction of the medium and a retracted position where the guide member is retracted to an end portion position side in the width direction. When the guide member is disposed at the advanced position, an upstream side end portion of the guide member in the discharge direction is disposed between a discharge position by the discharge roller pair and a position of the placement surface of the discharge tray, in the vertical direction.

15 Claims, 17 Drawing Sheets

(51) Int. Cl.
*B65H 29/34* (2006.01)
*B65H 29/52* (2006.01)
*B65H 31/30* (2006.01)

(52) U.S. Cl.
CPC . *B65H 31/3018* (2013.01); *B65H 2301/4213* (2013.01); *B65H 2404/152* (2013.01); *B65H 2404/693* (2013.01); *B65H 2701/1829* (2013.01); *B65H 2801/06* (2013.01)

(56) References Cited

U.S. PATENT DOCUMENTS 6,250,628 B1 * 6/2001 Klaus ..... B65H 29/34 271/213
6,471,204 B1 * 10/2002 Tamaki ..... B65H 29/34 271/176
6,659,454 B1 * 12/2003 Smith ..... B41J 13/106 271/207
7,506,865 B2 * 3/2009 Terao ..... B65H 37/04 270/58.08
7,798,481 B2 * 9/2010 Terao ..... B65H 31/10 270/58.04
8,262,085 B2 * 9/2012 Feygelman ..... B41J 11/0005 271/188
9,440,816 B2 * 9/2016 Stojanovski ..... B65H 31/3018
2006/0066028 A1 3/2006 Terao
2006/0066033 A1 3/2006 Terao
2006/0220293 A1 10/2006 Kaneko et al.
2007/0252320 A1 11/2007 Terao
2009/0066013 A1 3/2009 Terao
2009/0230612 A1 9/2009 Oshiro et al.
2010/0084808 A1 4/2010 Terao
2012/0045295 A1 * 2/2012 Sato ..... B65H 37/04 412/33
2013/0026702 A1 1/2013 Gamo et al.
2014/0292978 A1 10/2014 Kodama et al.

FOREIGN PATENT DOCUMENTS

JP 2007-254042 A 10/2007
JP 2010265116 A 11/2010
JP 2014-196182 A 10/2014

* cited by examiner

MEDIUM DISCHARGING DEVICE AND METHOD OF CONTROLLING MEDIUM DISCHARGING DEVICE

CROSS REFERENCE TO RELATED APPLICATIONS

The entire disclosure of Japanese Patent Application No. 2017-235470, filed Dec. 7, 2017 is expressly incorporated by reference herein.

BACKGROUND

1. Technical Field

The present disclosure relates to a medium discharging device that discharges a medium such as a sheet of paper and loads the discharged medium on a placement portion such as a discharge tray.

2. Related Art

In the related art, a printing apparatus including a transport portion that transports a medium such as a sheet of paper and a recording head that performs print on the medium has been widely known (for example, JP-A-2014-196182). A discharge tray is provided below a discharge port provided in a housing of the printing apparatus, and the medium after the printing, which is discharged from a discharge roller, is loaded on a placement surface of the discharge tray.

For example, in the printing apparatus (an example of a medium discharging device) disclosed in JP-A-2014-196182, a medium configured with, for example, a sheet paper is sequentially discharged to a stacker such as the discharge tray, and the discharged medium is loaded on a placement surface of the stacker. In the printing apparatus, in the discharge port that discharges the medium after the printing, in order to cope with curling on a paper discharging tray, a contact member which is in contact with the medium from the upper side is disposed, so that the medium can be loaded in an aligned state.

However, while the medium is discharged from the discharge port, as a tip end of a following medium subsequently discharged comes into contact with a preceding medium previously discharged and loaded on the placement surface of the discharge tray, while the following medium moves to a downstream side of a discharge direction, a tip end portion of the following medium is rolled downward, and thus downward folding occurs in which the following medium is folded when being loaded on an upper surface of the preceding medium. However, in a printing apparatus disclosed in JP-A-2014-196182, this kind of downward folding is not measured. Further, the disclosure is not limited to a case where a single medium is discharged, and this fact is also applied to a post-processing device (a finisher). That is, when the post-processing device discharges a paper bundle, a tip end of the following medium bundle subsequently discharged comes into contact with a preceding paper bundle previously discharged and placed on the placement surface of the discharge tray during the discharge, and downward folding occurs in which, for example, a lowermost one medium or a plurality of lowermost media among the following medium bundle are folded downward. This problem is not limited to the printing apparatus and the post-processing device and is common in a medium discharging device that discharges and loads a medium such as a sheet of paper.

SUMMARY

An advantage of some aspects of the disclosure is to provide a medium discharging device that can reduce folding of a discharged medium.

Hereinafter, means of the disclosure and operation effects thereof will be described.

According to an aspect of the disclosure, there is provided a medium discharging device for receiving a medium discharged from a discharge portion of a processing device. The medium discharging device includes: a placement portion that is disposed below a height position of the discharge portion in a vertical direction and has a placement surface on which the discharged medium is placed; and a guide member that is provided to be advanced and retracted between an advanced position where the guide member is advanced inward in a width direction intersecting a discharge direction of the medium from opposite sides in the width direction and a retracted position where the guide member is retracted to an end portion position side in the width direction, in which when the guide member is disposed at the advanced position, an upstream side end portion of the guide member in the discharge direction is disposed in a height position between a height position of a discharge position discharged by the discharge portion in the vertical direction and a height position of the placement surface of the placement portion in the vertical direction.

With this configuration, while the medium is discharged from the discharge portion, the medium is temporarily discharged while being supported, by the guide member that is advanced from the retracted position on opposite sides in the width direction to the advanced position on an inner side in the width direction. When the guide member is retracted to the retracted position, the medium is placed on an upper surface of the preceding medium on the placement surface. Therefore, folding of the discharged medium can be reduced.

In the medium discharging device, in the guide member, the other end side, which corresponds to the upstream side end portion, may be advanced and retracted between the advanced position and the retracted position with one end side on a downstream side of the discharge direction as a pivotal shaft.

With this configuration, since the guide member corresponds to a pivotal type in which the other end side can be advanced and retracted between the advanced position and the retracted position with one end side as a pivotal shaft, an elongated member can be used as the guide member. Thus, the medium discharging device can be downsized in the width direction.

In the medium discharging device, a height position of the other end side of the guide member in the vertical direction when the guide member is disposed at the advanced position may be lower than a height position of the other end side of the guide member in the vertical direction when the guide member is disposed at the retracted position.

With this configuration, since the guide member disposed at the advanced position is inclined to lower the other end side, the guide member guides the medium in a posture in which a downstream end (a tip end) thereof is higher than an upstream end (a rear end) thereof. Therefore, when the guide member is retracted to the retracted position and the medium is placed on the upper surface of the preceding medium, it is difficult for the medium to be displaced to the downstream side of the discharge direction. Thus, the medium can be aligned and loaded on the placement surface of the placement portion well.

In the medium discharging device, when the guide member moves from the retracted position to the advanced position, the other end side of the guide member may be advanced to an inside of a discharge path of the medium, which is an inside in the width direction, while maintaining a height position when the guide member is located at the retracted position, and may be lowered at a completely advanced position.

With this configuration, when the guide member moves from the retracted position to the advanced position, it is easy to avoid erroneous contact with the preceding medium. Thus, it is possible to reduce a frequency with which the guide member wrongly comes into contact with the preceding medium, alignment of the preceding medium is damaged, or the preceding medium is damaged.

In the medium discharging device, when the guide member moves from the advanced position to the retracted position, the other end side of the guide member may be retracted to an outside of a discharge path of the medium, which is an end portion position in the width direction, while maintaining a height position when the guide member is disposed at the advanced position, and is raised at a completely retracted position.

With this configuration, while the guide member moves from the advanced position to the retracted position, rising of the temporarily supported medium can be suppressed. Thus, the medium can be aligned and loaded on the placement surface well.

In the medium discharging device, the placement surface and the guide member disposed at the advanced position may be inclined in a state in which an upstream side is lower than a downstream side in the discharge direction, and when the guide member is disposed at the advanced position, an inclination of the guide member is larger than an inclination of the placement surface.

With this configuration, it is easier to place the medium on the upper surface of the preceding medium collected on an upstream side of the discharge direction. Thus, the medium can be aligned and loaded on the placement surface well.

In the medium discharging device, a friction coefficient of the guide member may be set to be equal to or lower than a friction coefficient of the placement surface of the placement portion.

With this configuration, while being discharged, the medium slides on the upper surface of the guide member as easily as or more easily than the placement surface of the placement portion. Therefore, the medium slides on the upper surface of the guide member without being caught. Thus, it is easy to avoid displacement of the medium caused by the catching or the like. From this point, the medium can be aligned and loaded on the placement surface of the placement portion well.

In the medium discharging device, the guide member may be advanced to the advanced position while a downstream side end portion of the medium discharged from the discharge portion in the discharge direction comes into contact with an upper surface of the medium previously discharged and placed on the placement portion, and may be retracted to the retracted position after an upstream side end portion of the medium in the discharge direction is discharged from the discharge portion.

With this configuration, since the guide member is advanced to the advanced position before the downstream side end portion of the medium in the discharge direction is in contact with the upper surface of the medium previously discharged and placed on the placement portion, contact between the guide member and the discharged medium can be avoided while the guide member is advanced to the advanced position. Therefore, position deviation of the medium, caused by the contact between the guide member and the medium during the movement, can be suppressed. Further, after the upstream side end portion of the medium in the discharge direction is discharged from the discharge portion, the guide member is retracted to the retracted position. Therefore, the guide member supports the medium at least while receiving a force for discharging the medium from the discharge portion, and is retreated from the advanced position after not receiving the force for discharging the medium from the discharge portion. Thus, the folding occurring as the medium is fed out to the downstream side of the discharge direction while the downstream side end portion of the medium in the discharge direction is in contact with the upper surface of the medium previously discharged and placed on the placement portion, can be effectively suppressed.

In the medium discharging device, the guide member may be advanced to the advanced position before the downstream side end portion of the medium in the discharge direction is discharged from the discharge portion.

With this configuration, it is possible to avoid the contact between the guide member and the medium discharged from the discharge portion while the guide member is advanced to the advanced position. Therefore, the position deviation of the medium, caused by the contact between the guide member and the medium during the movement, can be suppressed.

In the medium discharging device, when the guide member starts to be retracted from the advanced position to the retracted position, the upstream side end portion of the medium discharged from the discharge portion in the discharge direction may come into contact with an upper surface of the medium previously discharged and placed on the placement portion.

With this configuration, the guide member starts to be retracted from the advanced position in a state in which the upstream side end portion of the medium is in contact with the upper surface of the medium (the preceding medium) previously discharged and placed on the placement portion and receives contact resistance. Therefore, the position deviation of the medium guided to the upper surface of the guide member when the guide member is retracted hardly occurs. Thus, the medium can be aligned and loaded on the placement surface of the placement portion well.

In the medium discharging device, when the guide member is disposed at the retracted position, both one end side and the other end side of the guide member in the discharge direction may be disposed outside a discharge path of the medium in the width direction.

For example, if a part of the guide member is located inside the discharge path of the medium when the guide member is retracted, the position deviation may easily occur when the medium is caught by the part of the guide member and is dropped onto the upper surface of the preceding medium. With this configuration, since both one end side and the other end side of the guide member in the discharge direction are retracted to the outside of the medium in the discharge path, the position deviation hardly occurs when the support by the guide member is released and the medium is dropped onto the upper surface of the preceding medium.

In the medium discharging device, when the guide member is located at the advanced position, an upstream end side of a portion of the guide member, which is advanced inward in the width direction, in the discharge direction may be disposed on an upstream side of the discharge direction from a position where a tip end of the discharged medium on a downstream side of the discharge direction firstly comes into contact with an upper surface of the medium previously discharged and placed on the placement portion, in a state in which there is no guide member.

With this configuration, the medium can be supported by the guide member without bringing the tip end of the discharged medium into contact with the upper surface of the medium (the preceding medium) previously discharged and placed on the placement portion. Thus, the folding easily occurring when the tip end of the medium comes into contact with the upper surface of the preceding medium and the medium is fed out to the downstream side can be more effectively suppressed.

In the medium discharging device, the medium discharging device may further include a holding portion that holds and pivots the guide member, in which when the guide member is located at the advanced position, the holding portion also guides the medium together with the guide member.

With this configuration, since the holding portion is configured to guide the medium together with the guide member located at the advanced position, the holding portion can be disposed inwardly close to the discharge path of the medium. Thus, the medium discharging device can be downsized in the width direction as compared to a case where a device including the guide member and the holding portion is provided.

In the medium discharging device, the holding portion may move to an upstream side of the discharge direction when the guide member moves to the advanced position and may move to a downstream side of the discharge direction when the guide member moves to the retracted position.

With this configuration, while the guide member is retracted from the advanced position to the retracted position, the amount by which the position of the other end of the guide member is changed in the discharge direction can become relatively small. Thus, while the guide member is retracted from the advanced position, a force that is applied to the medium and is opposite to the discharge direction can be kept relatively small.

In the medium discharging device, a portion that is rotatable about an extending direction of the guide member as a rotary axis may exist in a portion of the guide member, which is advanced inward in the width direction.

With this configuration, the medium is supported by at least a part of a rotatable portion of the guide member, so that friction between the guide member and the medium can be reduced. For example, a damage to the alignment of the medium, caused by catching between the guide member and the medium during the retracting, can be suppressed.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

First Embodiment

Hereinafter, a first embodiment of the disclosure will be described with reference to the drawings. In the following drawings, in order to illustrate each member in a recognizable size, the scale of each member is illustrated to be different from an actual scale.

Figure 1:
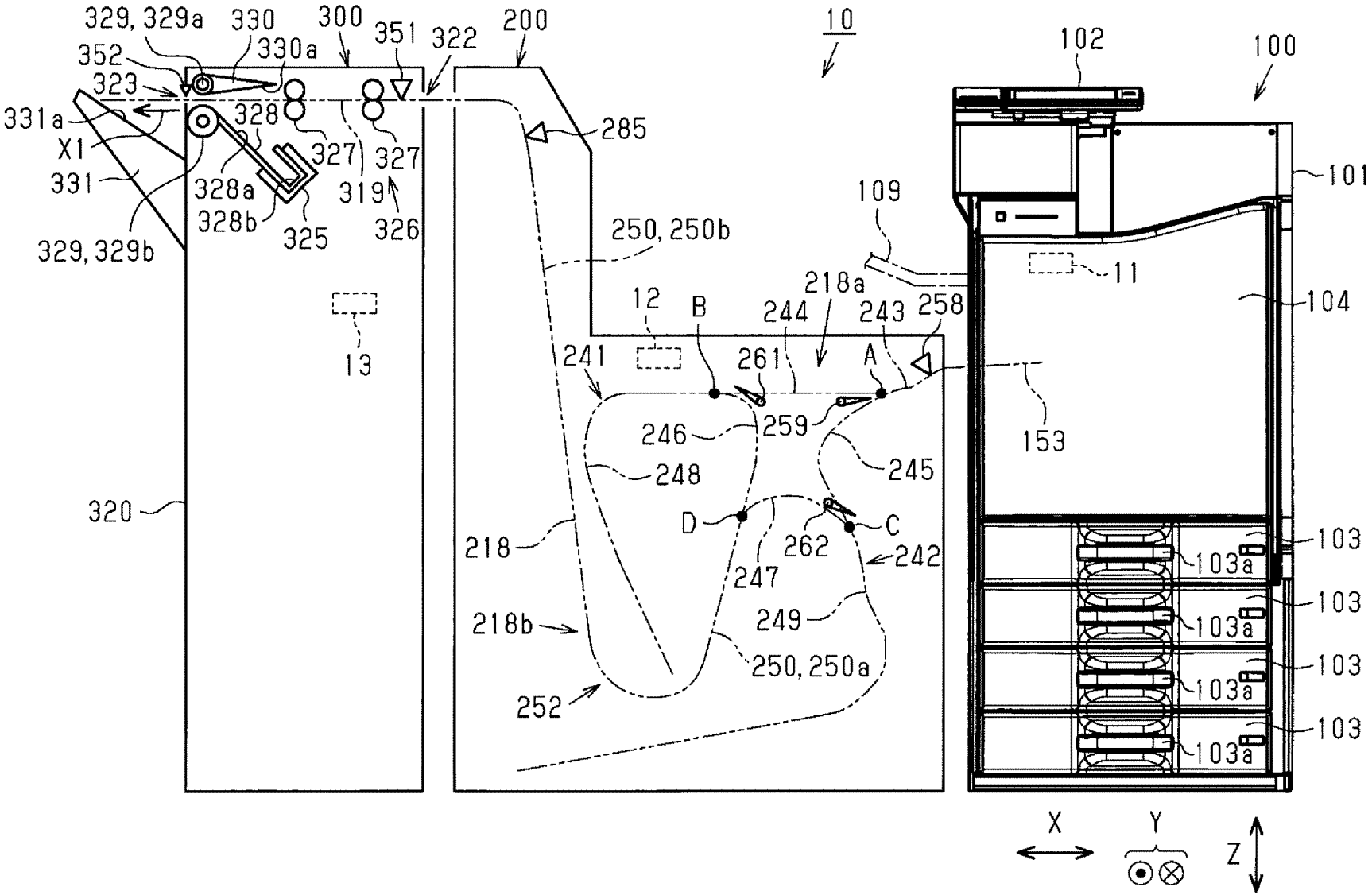
FIG. 1 is a schematic view illustrating a configuration of a printing apparatus according to a first embodiment.

Further, a configuration of a printing apparatus will be described. As illustrated in FIG. 1, a printing apparatus 10 includes an image forming device 100, an intermediate transporting device 200, and a post-processing device 300. Further, the devices 100, 200, and 300 include control units 11, 12, and 13 that control driving of mechanisms of the devices 100, 200, and 300, respectively. The respective control units 11 to 13 may communicate with each other. For example, the control unit 11 integrally controls the entire printing apparatus 10, and the control units 12 and 13 control the respective devices 200 and 300 according to an instruction of the control unit 11.

The image forming device 100 is a device that forms an image on a paper sheet M as an example of a medium. The post-processing device 300 is, for example, a device that performs post-processing such as a stapler process of stapling a plurality of paper sheets M on which images are formed, with a staple (a needle). In the present embodiment, the post-processing device 300 corresponds to an example of a medium discharging device. The intermediate transporting device 200 is a device that transports the paper sheet M on which an image is formed by the image forming device 100 to the post-processing device 300. The intermediate transporting device 200 is a device between the image forming device 100 and the post-processing device 300. The control unit may be shared between two or three devices of the respective devices 100, 200, and 300 constituting the printing apparatus 10.

In the printing apparatus 10 of the present embodiment, a third discharge path 153 as an upstream side transport path of the image forming device 100 is connected to an intermediate transport path 218 of the intermediate transporting device 200, and the intermediate transport path 218 is connected to a downstream side transport path 319 of the post-processing device 300. A continuous transport path (a two-dot chain line in FIG. 1) from the image forming device 100, which corresponds to an upstream side in a transport direction of the paper sheet M, via the intermediate transporting device 200 to the post-processing device 300 is configured by the upstream side transport path (the third discharge path 153), the intermediate transport path 218, and the downstream side transport path 319.

As illustrated in FIG. 1, the image forming device 100 is an ink jet printer that records an image such as a character, a figure, and a picture by attaching ink as an example of liquid to the paper sheet M, and has a substantially rectangular parallelepiped housing 101. An operation unit 102 for performing various operations of the image forming device 100 is provided above the housing 101.

In the image forming device 100, a paper cassette 103 is provided to extend from a central portion to a lower portion of the image forming device 100 in a vertical direction Z. In the present embodiment, the four paper cassettes 103 are arranged side by side in the vertical direction Z. The paper sheet M to be recorded by the image forming device 100 is accommodated in each paper cassette 103 in a stacked state. Further, a gripping portion 103*a* that can be gripped by a user is formed in the paper cassette 103. The paper cassette 103 may be attached/detached to/from the housing 101. The paper sheets M accommodated in the respective paper cassettes 103 may be different types or may be the same type.

A rectangular front plate cover 104 is provided above the uppermost paper cassette 103 in the vertical direction Z. The front plate cover 104 is provided to be pivotable about a long side thereof that is adjacent to the paper cassette 103 as a base end and is configured to be pivotable between two positions, that is, an open position where a tip end side that is opposite to the base end is spaced apart from the image forming device 100 and a closed position constituting a part of the housing 101.

Further, a paper discharging tray 109 extending from the housing 101 to the intermediate transporting device 200 is mountably provided at a part of the housing 101 on the intermediate transporting device 200 as needed. The paper sheet M discharged through a discharge port 108 (see FIG. 2) is placed on the paper discharging tray 109.

Figure 2:
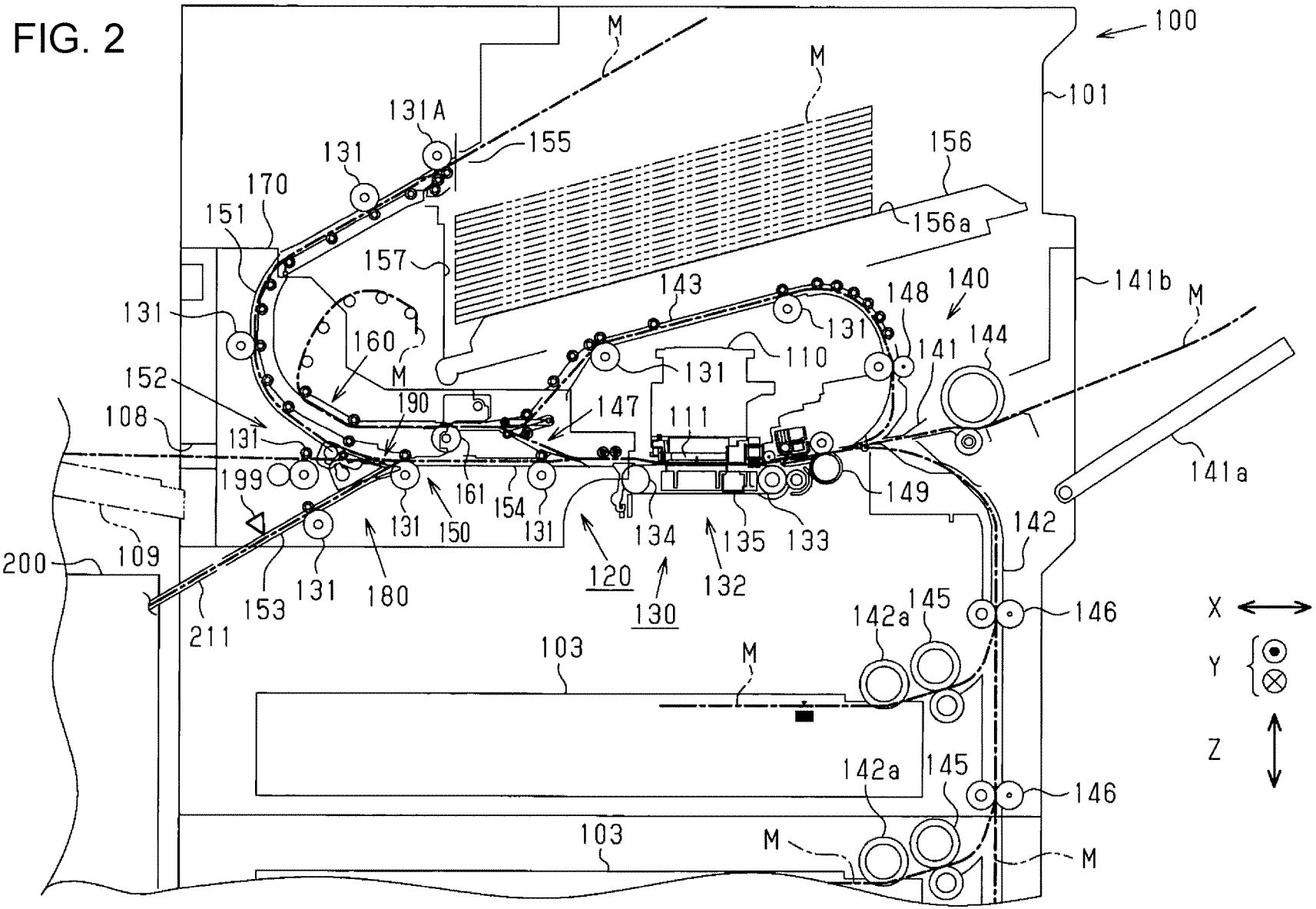
FIG. 2 is a structural sectional view illustrating a configuration of an image forming device.

Here, referring to FIG. 2, a configuration of the image forming device 100 will be described. As illustrated in FIG. 2, a recording unit 110 that records the paper sheet M from the upper side in the vertical direction Z and a transport portion 130 that transports the paper sheet M along a transport path 120 are provided inside the housing 101 of the image forming device 100. When a direction along a front-rear direction Y is set to a width direction of the paper sheet M, the transport path 120 is formed such that the paper sheet M is transported using a direction crossing the width direction as a transport direction.

The recording unit 110 includes a line head type recording head 111 that can simultaneously eject ink over substantially the entire area of the paper sheet M in the width direction. The recording unit 110 forms an image on the paper sheet M by attaching the ink ejected from the recording head 111 to a recording surface of the paper sheet M (a surface on which the image is printed), which faces the recording head 111.

The transport portion 130 has a plurality of transport roller pairs 131 arranged along the transport path 120 and driven by a transport driving motor (not illustrated) and a belt transport portion 132 provided directly below the recording unit 110. That is, as the ink is ejected from the recording head 111 to the paper sheet M transported by the belt transport portion 132, the recording is performed.

The belt transport portion 132 includes a driving roller 133 disposed on an upstream side of the recording head 111 in the transport direction, a driven roller 134 disposed on a downstream side of the recording head 111 in the transport direction, and an endless annular belt 135 hung on the respective rollers 133 and 134. As the driving roller 133 is driven and rotated, the belt 135 circulates, and the paper sheet M is transported to a downstream side by the circulating belt 135. That is, an outer peripheral surface of the belt 135 functions as a support surface for supporting the paper sheet M on which the recording is performed.

The transport path 120 includes a supply path 140 through which the paper sheet M is transported to the recording unit 110, a discharge path 150 on which the recording is performed by the recording unit 110 and through which the recorded paper sheet M is transported, and a branching path 160 branching at a branching mechanism 147.

The supply path 140 includes a first supply path 141, a second supply path 142, and a third supply path 143. In the first supply path 141, the paper sheet M inserted from an insertion port 141*b* exposed by opening a cover 141*a* provided on a right side surface of the housing 101 is transported to the recording unit 110. That is, the paper sheet M inserted from the insertion port 141*b* is linearly transported to the recording unit 110 by rotational driving of a first driving roller pair 144.

In the second supply path 142, in the vertical direction Z, the paper sheet M accommodated in the paper cassette 103 provided below the housing 101 is transported to the recording unit 110. That is, in the paper sheet M accommodated in the paper cassette 103 in a stacked state, the uppermost paper sheet M is sent out by a pickup roller 142*a*, is separated by a separation roller pair 145 one by one, is reversed while being transported in the vertical direction Z by rotational driving of the second driving roller pair 146, and is then transported to the recording unit 110.

In the third supply path 143, when duplex printing is performed in which images are recorded on opposite surfaces of the paper sheet M, the paper sheet M, one side of which has been recorded by the recording unit 110, is transported to the recording unit 110 again. That is, the branching path 160 branching off from the discharge path 150 is provided on a downstream side of the recording unit 110 in the transport direction. That is, when the duplex printing is performed, the paper sheet M is transported to the branching path 160 by an operation of the branching mechanism 147 provided in the discharge path 150. Further, in the branching path 160, a branching path roller pair 161 capable of both forward rotation and reverse rotation is provided on a downstream side of the branching mechanism 147.

When the duplex printing is performed, the paper sheet M, one surface of which is printed, is temporarily guided to the branching path 160 by the branching mechanism 147 and is transported to a downstream side of the branching path 160 by the branching path roller pair 161 performing the forward rotation. Then, the paper sheet M transported to the branching path 160 is reversely transported from the downstream side to an upstream side of the branching path 160 by the branching path roller pair 161 performing the reverse rotation. That is, the transport direction of the paper sheet M transported through the branching path 160 is reversed.

The paper sheet M reversely transported from the branching path 160 is transported to the third supply path 143, and is transported to the recording unit 110 by the plurality of transport roller pairs 131. As the paper sheet M is transported through the third supply path 143, the paper sheet M is reversed such that the other surface of the paper sheet M, which has not yet been printed, faces the recording unit 110, and is transported to the recording unit 110 by rotational driving of a third driving roller pair 148. That is, the third supply path 143 functions as a reverse rotation transport path through which the paper sheet M is reversed and supplied.

While being bent, the paper sheet M is transported to the recording unit 110 through the second supply path 142 and the third supply path 143 among the respective supply paths 141, 142, and 143. On the other hand, the paper sheet M is transported to the recording unit 110 through the first supply path 141 without being bent largely, as compared to the second supply path 142 and the third supply path 143.

The paper sheet M transported through the respective supply paths 141, 142, and 143 is transported to an alignment roller pair 149 disposed on an upstream side of the recording unit 110 in the transport direction, and a tip end of the paper sheet M then collides with the alignment roller pair 149 of which rotation is stopped. Further, an inclination of the paper sheet M in the transport direction is corrected (skew-removed) by a state in which the paper sheet M collides with such an alignment roller pair 149. The paper sheet M, the inclination of which is corrected, is brought into an alignment state and is transported to the recording unit 110 by subsequent rotational driving of the alignment roller pair 149.

The paper sheet M, on which one surface or opposite surfaces thereof are recorded by the recording unit 110 and the recording is completed, is transported along the discharge path 150 constituting a downstream side of the transport path 120 by the transport roller pairs 131. The discharge path 150 branches off into a first discharge path 151, a second discharge path 152, and a third discharge path 153 at a position corresponding to a downstream side of a position where the discharge path 150 branches from the branching path 160. That is, the completely recorded paper sheet M is transported through a common discharge path 154 (an upstream discharge path) constituting an upstream portion of the discharge path 150, and is then guided to any one of the respective discharge paths 151, 152, and 153 constituting a downstream portion of the discharge path 150 by a guide mechanism 180 (a switching guide portion) provided in a branching position 190 which is a downstream end of the common discharge path 154. The guide mechanism 180 is provided in the branching position 190 branching from the downstream end of the common discharge path 154 to the respective discharge paths 151, 152, and 153.

The first discharge path (an upper discharge path) 151 is a curved reversal path which curvedly extends toward the upper side of the housing 101, and through which the upside and the downside of the paper sheet M are reversed while the paper sheet M recorded by the recording unit 110 is transported to a discharge port 155 formed by opening a part of the housing 101 at a position which is a terminal end of the first discharge path 151.

Through the first discharge path 151, the recording surface of the paper sheet M recorded by the recording unit 110 is bent inward, and the paper sheet M is reversed from a state in which the recording surface of the paper sheet M faces the upper side to a state in which the recording surface of the paper sheet M faces the lower side. The paper sheet M transported through the first discharge path 151 is discharged from the discharge port 155 through a discharge roller pair 131A located at the terminal end among the plurality of transport roller pairs 131 provided at a plurality of positions along the first discharge path 151. The paper sheet M discharged from the discharge port 155 is dropped downward in the vertical direction Z and is discharged to a placement stand 156 while being stacked on a placement surface 156*a*, as illustrated by a two-dot chain line in FIG. 2. The paper sheet M is discharged from the discharge port 155 to the placement stand 156 in a posture in which the recording surface faces the lower side in the vertical direction Z, during simplex printing, by the transport roller pairs 131 disposed at a plurality of positions of the discharge path 150. Further, during the duplex printing, after recording is firstly performed on one surface of the paper sheet M, the paper sheet M is reversed. The paper sheet M is discharged to the placement stand 156 in a posture in which the recording surface formed as recording is performed on the other surface of the paper sheet M later faces the lower side in the vertical direction Z.

The placement stand 156 has an inclined shape that rises upward in the vertical direction Z as it goes to the right side in a left-right direction X. The paper sheet M is placed on the placement stand 156 in a stacked state. In this case, the paper sheet M placed on the placement stand 156 moves in a left-right direction along an inclination of the placement stand 156, and is placed to be close to a regulation wall 157 having a substantially vertical surface provided on a lower side of the discharge port 155 of the housing 101.

The second discharge path 152 branches to a lower side in the vertical direction Z from the first discharge path 151, and linearly (transversely) extends from the recording unit 110 to the intermediate transporting device 200. Therefore, the paper sheet M transported through the second discharge path 152 is linearly transported while a posture thereof is maintained constant, so the paper sheet M passes through the recording unit 110, and is discharged from the discharge port 108 to the paper discharging tray 109. That is, the second discharge path 152 functions as a non-reversing discharge path through which the paper sheet M is transported to the paper discharging tray 109 while the posture of the paper sheet M is not reversed.

The third discharge path 153 branches to a lower side in the vertical direction Z from the second discharge path 152, and extends slantingly downward in the vertical direction Z to face a lower side of the housing 101. A downstream end of the third discharge path 153 is connected to an introduction path 211 located at an upstream end of the intermediate transport path 218 of the intermediate transporting device 200. Thus, the paper sheet M transported through the third discharge path 153 is discharged to the intermediate transporting device 200. A transport detecting unit 199 that can detect whether or not there is the paper sheet M is provided in the third discharge path 153. The transport detecting unit 199 is, for example, a light transmission type or light reflection type photo-interrupter, and includes a light emitting unit that generates a light beam and a light receiving unit that receives the generated light beam from the light emitting unit. For example, a light emitting diode (LED), a laser beam emitting element, or the like is applied as a light emitting element of the light emitting unit. Further, the light receiving unit is configured with a phototransistor, a photo IC, or the like. Whether or not there is the paper sheet M (an ON/OFF state of light reception in the light receiving unit) can be detected by the light emitting unit and the light receiving unit.

The transport detecting unit 199 is connected to the control unit 11, and driving of the transport detecting unit 199 is controlled based on a predetermined program. The control unit 11 drives the transport detecting unit 199 and compares the amount of received light in the light receiving unit with a predetermined threshold to detect whether or not there is the paper sheet M. When presence and absence of the paper sheet M are repeatedly detected in synchronization with driving of the transport roller pairs 131, it is determined that the paper sheet M is normally transported. Meanwhile, a state in which the amount of received light in the light receiving unit does not change continues within a predetermined timing or a predetermined time, it is determined that a current state is an abnormal state (a jam state). For example, when the paper sheet M is not normally transported from the recording head 111 due to occurrence of a transport defect of the paper sheet M, it is determined that current state is an abnormal state (a jam state).

A part of the discharge path 150 and a part of the branching path 160 are attached to a drawer unit 170 provided in the housing 101. The drawer unit 170 is configured to be attachable/detachable to/from the housing 101.

Here, it is preferable that the paper sheet M that can be applied to the printing apparatus 10 have hygroscopicity and flexibility. Examples of the paper sheet M include plain paper such as electrophotographic copy paper, and inkjet paper having a water-soluble ink absorbing layer containing silica, alumina, polyvinyl alcohol (PVA), polyvinyl pyrrolidone (PVP) or the like. Further, examples of an absorptive medium to be recorded of which a penetration speed of water-soluble ink is comparatively small include art paper used for general offset printing, coated paper, cast paper, and the like. Further, examples of the paper sheet M may include high-quality paper, PPC copy paper, non-coated printing paper, and the like.

Next, the intermediate transporting device 200 will be described with reference to FIG. 1. As illustrated in FIG. 1, the intermediate transporting device 200 includes an intermediate transporting portion 252 which can transport the paper sheet M. The intermediate transporting portion 252 includes at least one reversal portion (in the present embodiment, both a first reversal portion 241 and a second reversal portion 242) which reverses the transported paper sheet M. The first reversal portion 241 and the second reversal portion 242 are located on a downstream side of the recording unit 110 in the transport direction and reverse the paper sheet M on which the image is formed (printed). Further, the intermediate transporting device 200 includes an intermediate transport path 218 through which the paper sheet M is transported. Thus, the intermediate transporting device 200 has a drying function of transporting and drying the paper sheet M on which the image is formed in the image forming device 100 and a reversing function of reversing the paper sheet M transported from the image forming device 100.

The intermediate transport path 218 of the intermediate transporting device 200 is connected to the third discharge path 153 of the image forming device 100. Further, the intermediate transport path 218 includes an introduction path 243 connected to the third discharge path 153 at an upstream end thereof, and a first branching path 244 and a second branching path 245 branching at a branching point A which is a downstream end of the introduction path 243. That is, the downstream end of the introduction path 243, an upstream end of the first branching path 244, and an upstream end of the second branching path 245 are connected to each other at the branching point A. The path lengths of the first branching path 244 and the second branching path 245 in the transport direction are substantially equal to each other.

The intermediate transport path 218 further includes a first joining path 246 connected to a first connection point B which is a downstream end of the first branching path 244 and a second joining path 247 connected to a second connection point C which is a downstream end of the second branching path 245. The path lengths of the first joining path 246 and the second joining path 247 in the transport direction are substantially equal to each other.

Further, a first reversal path 248 of the first reversal portion 241 is connected to the first connection point B. Further, a second reversal path 249 of the second reversal portion 242 is connected to the second connection point C. That is, the downstream end of the first branching path 244, an upstream end of the first joining path 246, and one end of the first reversal path 248 are connected to each other at the first connection point B. Further, the downstream end of the second branching path 245, an upstream end of the second joining path 247, and one end of the second reversal path 249 are connected to each other at the second connection point C. The path lengths of the first reversal path 248 and the second reversal path 249 are configured to be equal to or more than the length of the paper sheet M, on which the image can be formed (printed) by the image forming device 100, in the transport direction.

The intermediate transport path 218 further includes a lead-out path 250 provided at a joining point D at which the first joining path 246 and the second joining path 247 are joined to each other, and connected to the joining point D. That is, a downstream end of the first joining path 246, a downstream end of the second joining path 247, and an upstream end of the lead-out path 250 are connected to each other at the joining point D. The lead-out path 250 extends downward between the first reversal path 248 and the second reversal path 249 toward the post-processing device 300, extends around the first reversal path 248, and then extends upward. The lead-out path 250 includes a first lead-out path **250*a* disposed on an upstream side thereof and a second lead-out path 250***b* disposed on a downstream side of the first lead-out path 250*a*. A downstream end of the second lead-out path 250*b* is connected to the downstream side transport path 319 of the post-processing device 300.

In the present embodiment, a pre-reversal path 218*a* includes the introduction path 243, the first branching path 244, and the second branching path 245, and a post-reversal path 218*b* includes the first joining path 246, the second joining path 247, and the lead-out path 250. The pre-reversal path 218*a* is located on an upstream side of the first reversal portion 241 or the second reversal portion 242 in the transport direction. The post-reversal path 218*b* is located on a downstream side of the first reversal portion 241 or the second reversal portion 242 in the transport direction. That is, the intermediate transport path 218 includes the pre-reversal path 218*a* located on the upstream side of the first reversal portion 241 and the second reversal portion 242 in the transport direction and the post-reversal path 218*b* located on the downstream side of the first reversal portion 241 and the second reversal portion 242 in the transport direction.

Further, the intermediate transporting device 200 illustrated in FIG. 1 includes an intermediate transport portion (not illustrated) through which the paper sheet M can be transported along the intermediate transport path 218. The intermediate transport portion includes a plurality of transport roller pairs through which the paper sheet M can be transported along the intermediate transport path 218. The first reversal portion 241 and the second reversal portion 242 can reverse the transported paper sheet M.

A plurality of transport roller pairs (not illustrated) through which the paper sheet M is transported using a first driving motor as a common power source are provided on the introduction path 243, the first branching path 244, and the second branching path 245. Further, a plurality of transport roller pairs (not illustrated) through which the paper sheet M is transported using a second driving motor as a common power source are provided on the first joining path 246, the second joining path 247, and the first lead-out path 250*a*. Further, a plurality of transport roller pairs (not illustrated) through which the paper sheet can be transported using a third driving motor as a power source are provided on the second lead-out path 250*b*. In a state in which the roller pairs of the intermediate transport portion insert and support the paper sheet M between both the inside and the outside of the paper sheet M, as one roller among the roller pairs is rotationally driven, the paper sheet M is transported along the transport path.

Further, an introduction detecting unit 258 that detects the paper sheet M is provided in the introduction path 243. The introduction detecting unit 258 is, for example, a photo interrupter, and has a detailed configuration which is the same as that of the transport detecting unit 199. A guide flap 259 is provided at the branching point A on a downstream side of the introduction detecting unit 258 in the transport direction. The guide flap 259 is driven by a solenoid or the like, and switches to which path of the first branching path 244 and the second branching path 245 the paper sheet M transported through the introduction path 243 is guided.

Further, a first regulating flap 261, which permits movement of the paper sheet M from the first branching path 244 to the first reversal path 248 and regulates movement of the paper sheet M from the first reversal path 248 to the first branching path 244, is provided at the downstream end of the first branching path 244. Further, a second regulating flap 262, which permits movement of the paper sheet M from the second branching path 245 to the second reversal path 249 and regulates movement of the paper sheet M from the second reversal path 249 to the second branching path 245, is provided at the downstream end of the second branching path 245. The first regulating flap 261 and the second regulating flap 262 are energized to close the downstream end of the first branching path 244 or the second branching path 245 by an energization force generated by an energization member (not illustrated).

Further, detection units that detect the paper sheet M are disposed in the first branching path 244, the second branching path 245, the first joining path 246, the second joining path 247, the first lead-out path 250*a*, and the second lead-out path 250*b*, respectively. For example, a detection unit 285 that detects the paper sheet M on the upstream side of a discharge position, where the paper sheet M is discharged from the intermediate transporting device 200, in the transport direction is disposed in the second lead-out path 250*b*. The detection units and the detection unit 285 are, for example, photo interrupters, and have detailed configurations which are the same as that of the transport detecting unit 199. The number of the detection units in the transport paths can be set depending on the forms and the like of the transport paths in a predetermined manner.

A detection unit that detects the paper sheet M fed to the first reversal path 248 and a first reversal roller pair (not illustrated) provided on the first reversal path 248 are disposed in the first reversal portion 241. The first reversal roller pair performs forward rotation driving and reverse rotation driving by a first reversal motor (not illustrated), based on a signal transmitted when the detection unit detects the paper sheet M.

Further, a detection unit that detects the paper sheet M fed to the second reversal path 249 and a second reversal roller pair (not illustrated) provided on the second reversal path 249 are disposed in the second reversal portion 242. The second reversal roller pair performs forward rotation driving and reverse rotation driving by a second reversal motor (not illustrated), based on a signal transmitted when the detection unit detects the paper sheet M. The detection unit is, for example, a photo interrupter, and has a detailed configuration which is the same as that of the transport detecting unit 199.

Next, a configuration of the post-processing device 300 will be described. As illustrated in FIG. 1, the post-processing device 300 includes a substantially box-shaped frame 320. The frame 320 includes a post-processing paper feeding port 322 and a post-processing paper discharging port 323. The post-processing paper feeding port 322 and the post-processing paper discharging port 323 have openings, respectively. The post-processing paper feeding port 322 is disposed to correspond to a downstream end of the intermediate transport path 218 of the intermediate transporting device 200, and is connected to the intermediate transport path 218 and the downstream side transport path 319. The downstream side transport path 319 is disposed from the post-processing paper feeding port 322 to the post-processing paper discharging port 323. The paper sheet M transported from the intermediate transporting device 200 is supplied from the post-processing paper feeding port 322, is post-processed, and is then discharged from the post-processing paper discharging port 323.

A stacker 328, a post-processing unit 325, and the like are disposed inside the frame 320. The stacker 328 temporarily places the paper sheet M, and includes a placement surface 328*a* having a substantially flat surface on which the paper sheet M can be placed and a wall surface 328*b* formed in a direction that is substantially perpendicular to an end portion of the placement surface 328*a*.

The post-processing unit 325 performs, using a suitable mechanism, post-processing including a punching process of punching a punched hole in the paper sheet M, a stapling process of binding the paper sheet M by a predetermined number of sheets, a shifting process of shifting and adjusting a widthwise position of the paper sheet M in the width direction for each sheet or each bundle, and the like, with respect to the paper sheet M laced on the stacker 328. The post-processing unit 325 includes a paper folding unit that folds the paper sheet M and a mechanism that can perform a cutting process of cutting the paper sheet M, a signature process of folding the paper sheet M, a bookbinding process of binding the paper sheet M, a collating process, and the like.

Further, a downstream side transport portion 326 is disposed inside the frame 320 along the downstream side transport path 319. The downstream side transport portion 326 includes a transport roller pair 327 driven by a driving roller (not illustrated). A discharge roller pair 329 as an example of a discharge portion is disposed near the post-processing paper discharging port 323 in the downstream side transport path 319. The transport roller pair 327 is disposed on an upstream side of the stacker 328 and the post-processing unit 325 in the downstream side transport path 319, and transports the paper sheet M fed from the post-processing paper feeding port 322 to the stacker 328. Further, an entry detecting unit 351 as an example of a first detection unit that detects the paper sheet M is provided near the post-processing paper feeding port 322 in the downstream side transport path 319. The entry detecting unit 351 is, for example, a photo interrupter, and has a detailed configuration which is the same as that of the transport detecting unit 199.

Further, a guide portion 330 that guides the transported paper sheet M along the downstream side transport path 319 is provided inside the frame 320. The guide portion 330 has a protruding shape. The guide portion 330 includes a guide surface 330*a* having a substantially flat surface, and the guide surface 330*a* is disposed to face the downstream side transport path 319 (the stacker 328). A dimension width that is substantially perpendicular to the transport direction of the paper sheet M on the guide surface 330*a* of the present embodiment is substantially the same as a dimension width of the paper sheet M, which is substantially perpendicular to the transport direction. Accordingly, the paper sheet M can be easily transported. The guide portion 330 is disposed on a downstream side of the transport roller pair 327 and on an upstream side of the discharge roller pair 329 in the downstream side transport path 319. Thus, the paper sheet M transported from the transport roller pair 327 is transported to the stacker 328 through the guide portion 330.

The stacker 328 of the present embodiment is disposed on a downstream side of the transport roller pair 327 in the downstream side transport path 319, and temporarily places the paper sheets M that are processed by the post-processing unit 325. The placement surface 328*a* of the stacker 328 is disposed in an oblique direction such that at least end sides of the plurality of paper sheets M placed on the stacker 328 are aligned with each other. In the present embodiment, one end of the stacker 328 is disposed on the post-processing paper discharging port 323 side, and the other end (the wall surface 328*b*) of the stacker 328 is disposed on the post-processing unit 325 side. The post-processing paper discharging port 323 is disposed above the post-processing unit 325, and the stacker 328 is disposed toward the post-processing unit 325, which is located below, in a diagonal direction. Accordingly, as the end sides of the paper sheets M placed on the stacker 328 come into contact with the wall surface 328*b* of the stacker 328, the end sides of the paper sheets M are aligned with each other.

As illustrated in FIG. 1, the discharge roller pair 329 of the post-processing device 300 is disposed at one end side of the stacker 328, and is configured to discharge the paper sheet M placed on the stacker 328 for each sheet or each bundle including a predetermined number of sheets. The discharge roller pair 329 includes a first discharge roller 329*a* and a second discharge roller 329*b*. The first discharge roller 329*a* and the second discharge roller 329*b* are arranged in the vertical direction Z, and the first discharge roller 329*a* is disposed at a position that is higher than the second discharge roller 329*b*. The first discharge roller 329*a* and the second discharge roller 329*b* may be spaced apart from each other or may be in press-contact with each other. In the present embodiment, the first discharge roller 329*a* is configured to be movable with respect to the second discharge roller 329*b* by a driving motor.

When the paper sheet M transported from the transport roller pair 327 is placed on the stacker 328, the discharge roller pair 329 is spaced. At this time, the first discharge roller 329*a* is disposed at a first position where a distance between the first discharge roller 329*a* and the second discharge roller 329*b* is maximized. The distance is a distance in a direction in which the paper sheet M is inserted between the first discharge roller 329*a* and the second discharge roller 329*b*, and is a shortest dimension between an outmost peripheral surface of the first discharge roller 329*a* and an outmost peripheral surface of the second discharge roller 329*b*. In this state, after a part of the paper sheet M passes through a gap between the first discharge roller 329*a* and the second discharge roller 329*b*, the paper sheet M comes into press-contact with (nip) the first discharge roller 329*a* and the second discharge roller 329*b* to be inserted between the first discharge roller 329*a* and the second discharge roller 329*b*, and the discharge roller pair 329 rotates in a direction in which the paper sheet M returns to the stacker 328 side. Accordingly, the paper sheet M is placed on the stacker 328. In this case, the first discharge roller 329*a* moves to a nip position below the first position, in which the paper sheet M comes into press-contact with the first discharge roller 329*a* and the second discharge roller 329*b*. The returning operation in a state in which the first discharge roller 329*a* and the second discharge roller 329*b* are spaced apart from each other or are in press-contact with each other is repeated until a predetermined number of the paper sheets M are placed on the stacker 328.

A discharge tray 331 as an example of a placement portion is provided below the post-processing paper discharging port 323 outside the frame 320. The discharge tray 331 loads the paper sheet M discharged from the post-processing paper discharging port 323. The discharge tray 331 is disposed below the discharge roller pair 329 in the vertical direction Z, and has a placement surface 331*a* on which the discharged paper sheet M is loaded (placed). A downstream end of the discharge tray 331 in a discharge direction X1 is located above an upstream end of the discharge tray 331 in the vertical direction Z, and the discharge tray 331 protrudes diagonally upward to the outside of the frame 320.

When a paper bundle M1 post-processed by the post-processing unit 325 is discharged to the discharge tray 331 side, the discharge roller pair 329, which comes into press-contact with a predetermined number of paper bundles M1, is rotated in a direction in which the paper sheet M is transported to a side that is opposite to the stacker 328 side. Accordingly, the paper bundle M1 can be discharged to the discharge tray 331 side. In the present embodiment, the discharge roller pair 329 (the first discharge roller 329*a* and the second discharge roller 329*b*) corresponds to an example of a discharge roller.

Further, a discharge detecting unit 352 as an example of a second detection unit, which detects the paper sheet M or the paper bundle M1 discharged from the post-processing paper discharging port 323, is disposed near the post-processing paper discharging port 323 on a downstream side of the discharge roller pair 329. The discharge detecting unit 352 is, for example, a photo interrupter, and has a detailed configuration which is the same as that of the transport detecting unit 199. A detection signal generated by the discharge detection unit 352 is transmitted to the control unit 13.

Figure 3:
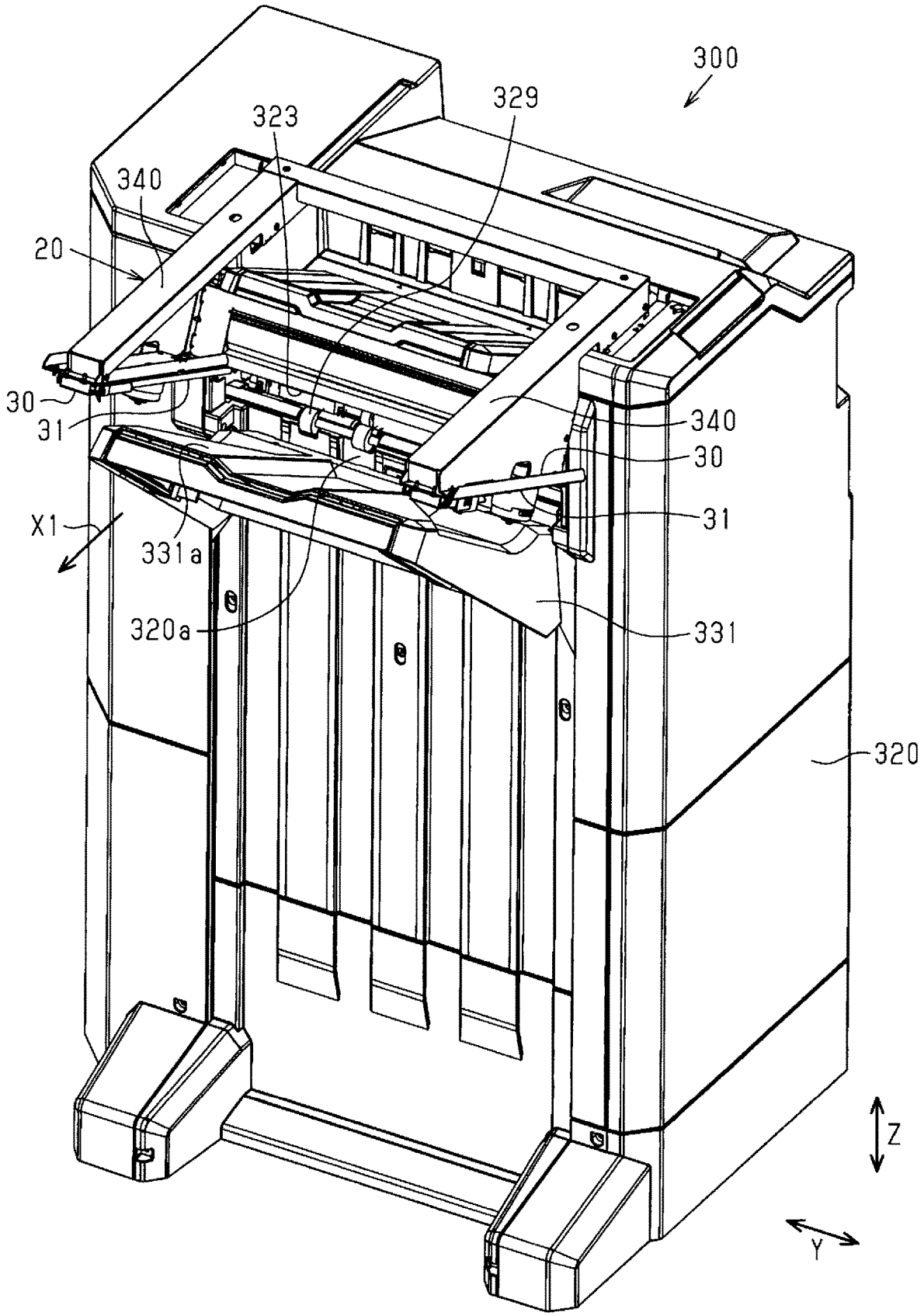
FIG. 3 is a perspective view illustrating a post-processing device.

As illustrated in FIG. 3, the post-processing device 300 includes the rectangular box-shaped frame 320 elongated in the vertical direction Z and the discharge tray 331 on which the paper bundle M1 discharged from the post-processing paper discharging port 323 is loaded. The discharge tray 331 is provided to be raised and lowered in the vertical direction Z along a side surface of the frame 320 to which the post-processing paper discharging port 323 is opened.

As illustrated in FIG. 3, the post-processing device 300 includes a folding preventing device 20 that guides the paper bundle M1 discharged from the discharge roller pair 329 before the paper bundle M1 is dropped onto the placement surface 331*a* of the discharge tray 331 or an upper surface of the paper sheet M (a preceding paper sheet) previously discharged and placed on the placement surface 331*a*, and prevents downward folding of the paper bundle M1. Here, the downward folding is a phenomenon in which a downstream end (a tip end) of the following paper sheet M discharged from the post-processing paper discharging port 323 in the discharge direction X1 comes into contact with the upper surface of the paper sheet M previously discharged and placed on the discharge tray 331, and one paper sheet or a plurality of paper sheets on the lower side are folded downward.

The folding preventing device 20 includes a pair of guide units 30 which are disposed above the placement surface 331*a* of the discharge tray 331 when the discharge tray 331 is located at an uppermost position and into which a discharge area of the paper bundle M1 discharged from the discharge roller pair 329 of the post-processing paper discharging port 323 is inserted on opposite sides in a width direction Y. The pair of guide units 30 are supported on a pair of support arms 340 extending from opposite sides in the width direction Y at an upper end portion of the frame 320 to a downstream side in the discharge direction X1. As illustrated in FIG. 3, the pair of guide units 30 have a pair of guide members 31 which are located on the downstream side in the discharge direction X1 from the discharge roller pair 329 and can guide the paper bundle M1 discharged from the discharge roller pair 329.

As illustrated in FIG. 3, a regulation wall 320*a*, which is a part of the frame 320 and has a substantially vertical surface, is provided between a discharge position (a nip position) of the paper bundle M1 from the discharge roller pair 329 and the placement surface 331*a* of the discharge tray 331. The paper bundle M1 discharged to the discharge tray 331 is aligned as an upstream end (a rear end) of the paper bundle M1 in the discharge direction X1 comes into contact with the regulation wall 320*a*.

Figure 4:
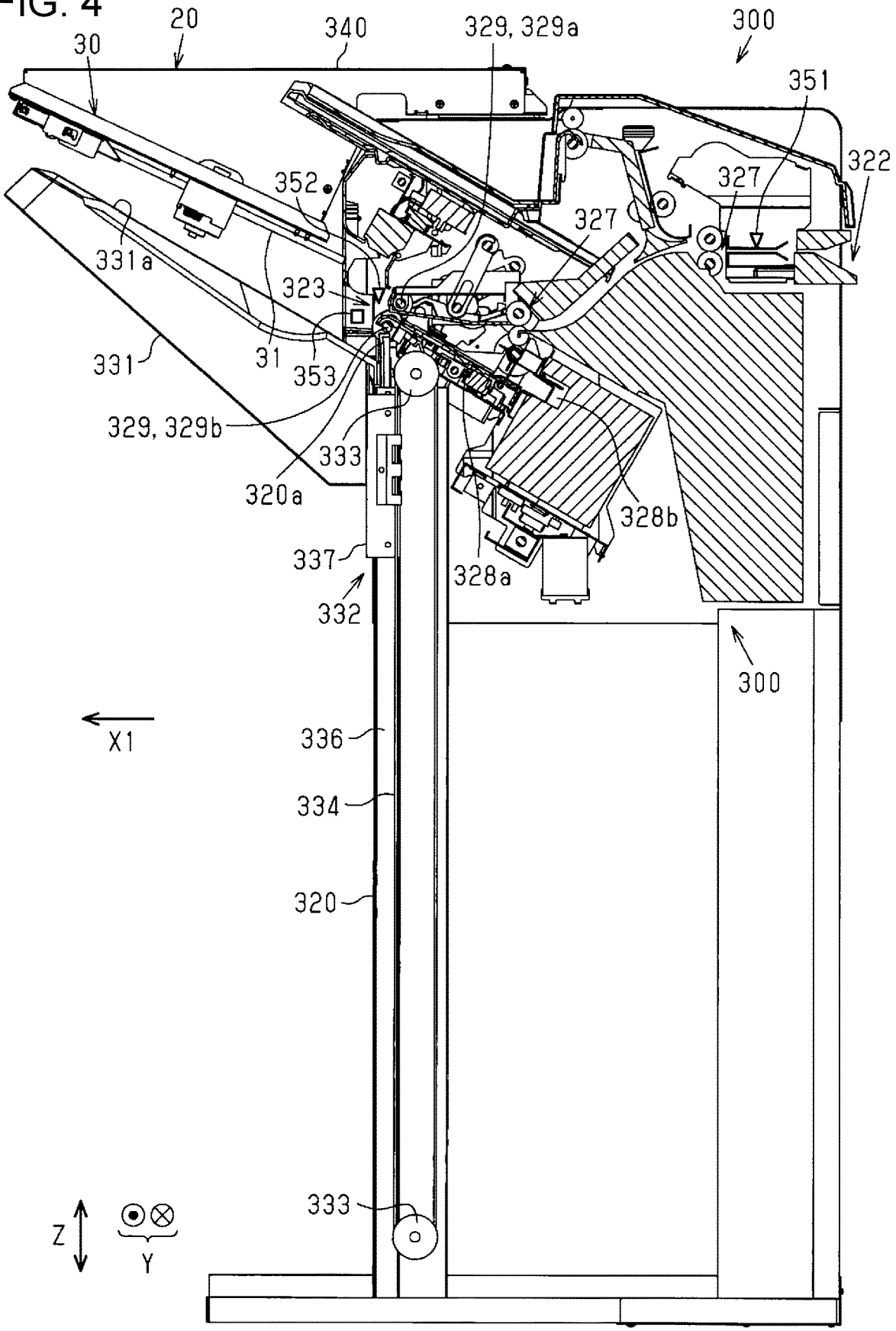
FIG. 4 is a side sectional view illustrating the post-processing device.

As illustrated in FIG. 4, the discharge tray 331 is configured to be movable upward or downward (that is, be raised or lowered) in the vertical direction Z by an elevation mechanism 332. The elevation mechanism 332 includes an endless timing belt 334 wound around a pair of pulleys 333 spaced apart from each other by a predetermined distance in the vertical direction Z and an elevation motor 335 (see FIG. 19) serving as a power source of the elevation mechanism 332. An output shaft of the elevation motor 335 is connected to one of the driving pulleys 333 via a gear mechanism (not illustrated) to enable power transmission. The discharge tray 331 is configured to be elevatable while being guided by a guide rail 336 formed on one side surface of the frame 320 on the post-processing paper discharging port 323 side. A base end portion of the discharge tray 331 is connected to the timing belt 334 through a connection member 337. Thus, the discharge tray 331 is raised or lowered as the elevation motor 335 performs forward rotation driving or reverse rotation driving.

Further, a paper surface detecting unit 353, which detects a position of an upper surface of the paper sheet M (the preceding paper sheet) placed on the discharge tray 331, is provided near the post-processing paper discharging port 323. A detection signal generated by the paper surface detecting unit 353 is transmitted to the control unit 13 (see FIG. 1) and is used for elevation control of the discharge tray 331. The control unit 13 controls elevation of the discharge tray 331 such that the other ends 31*b* (tip ends, see FIG. 5), which are upstream ends of the pair of guide members 31 in the discharge direction X1 when the guide members 31 are located at an advanced position, are located above the placement surface 331*a* and an upper surface of the paper sheet M loaded on the placement surface 331*a*. In detail, the control unit 13 controls the elevation mechanism 332 based on the position of the upper surface detected by the paper surface detecting unit 353, to raise and lower the discharge tray 331 such that the upper surface of the paper sheet M placed on the placement surface 331*a* is located within a range of a predetermined distance below the nip position of the discharge roller pair 329 in the vertical direction Z. For example, whenever the loading height of the paper sheet M loaded on the placement surface 331*a* is increased and the height of the upper surface of the paper sheet M, which is detected by the paper surface detecting unit 353, exceeds a threshold, the control unit 13 drives the elevation motor 335 to control the position of the discharge tray 331 to a position where the paper sheet M loaded on the placement surface 331*a* and the guide members 31 being operated do not interfere with each other. Further, the control unit 13 controls an operation of the pair of guide members 31 of the folding preventing device 20, based on a detection signal from the entry detecting unit 351 and a detection signal from the discharge detecting unit 352.

Figure 5:
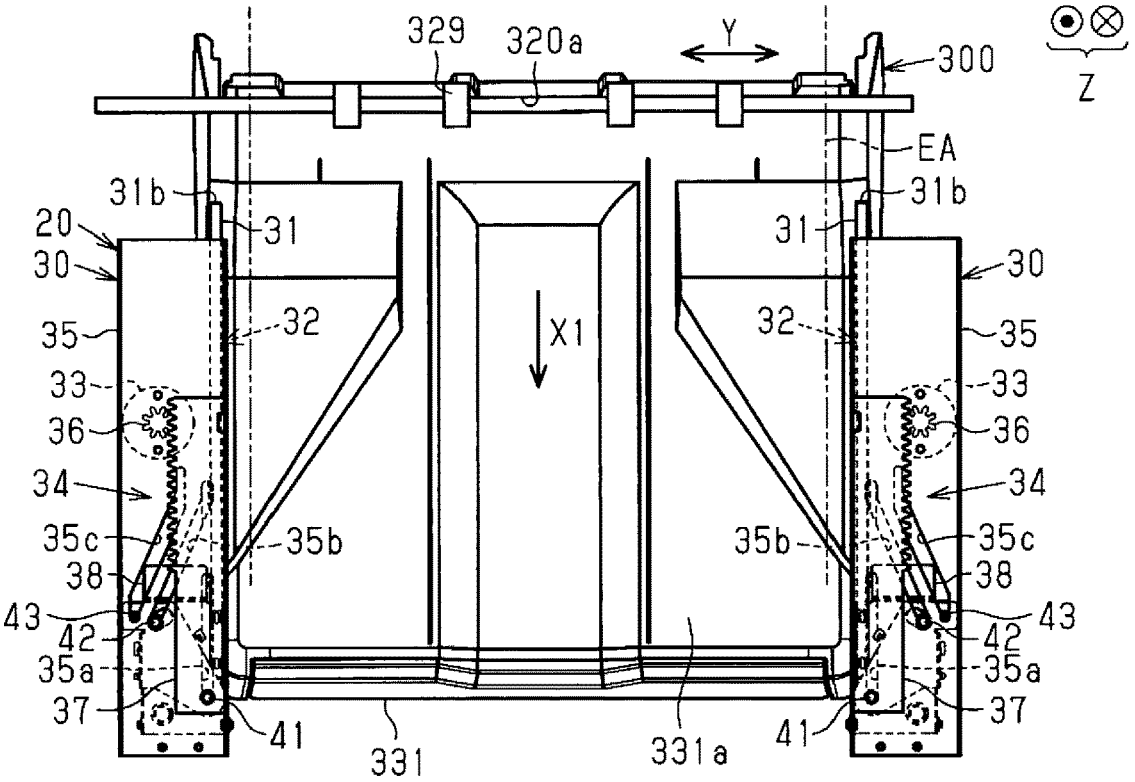
FIG. 5 is a plan view illustrating a folding preventing device when a pair of guide members are located at a retracted position.
Figure 6:
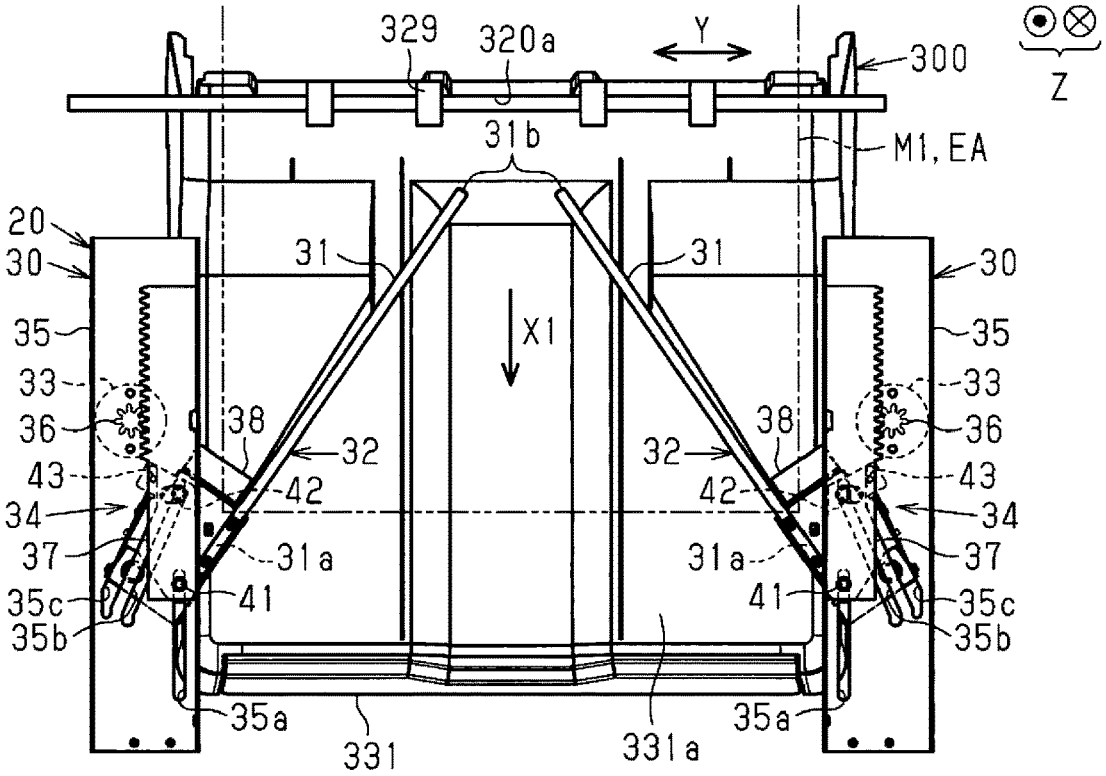
FIG. 6 is a plan view illustrating the folding preventing device when the pair of guide members are located at an advanced position.

Next, a detailed configuration of the folding preventing device 20 will be described with reference to FIGS. 5 to 17. As illustrated in FIGS. 5 and 6, the folding preventing device 20 has the pair of left and right guide units 30. The pair of guide units 30 have the rod-shaped guide members 31, respectively. In the folding preventing device 20, as the pair of guide units 30 are driven in synchronization with each other, the pair of guide members 31 are operated in synchronization. Each of the guide units 30 has a plate-shaped guide frame 35 extending in the discharge direction X1, an electric motor 33 which is a power source assembled in the guide frame 35, a guide-movable body 32 having the guide member 31, and a driving mechanism 34 that drives the guide-movable body 32 by power of the electric motor 33.

As illustrated in FIGS. 5 and 6, the driving mechanism 34 is a rack-and-pinion mechanism in the present example. The driving mechanism 34 includes a pinion 36 fitted in an output shaft of the electric motor 33 and a rack member 37 engaged with the pinion 36. The guide-movable body 32 having a holding member 38 as an example of a holding portion that holds the guide member 31 is connected to a downstream side end portion of the rack member 37 in the discharge direction X1 to be pivotable about a pivotal shaft 41. The pivotal shaft 41, a first guide shaft 42, and a second guide shaft 43 of the guide-movable body 32 are guided along a first guide groove 35*a*, a second guide groove 35*b*, and a third guide groove 35*c* which are formed in the guide frame 35 to extend in the discharge direction X1.

As illustrated in FIGS. 5 and 6, in the folding preventing device 20, when the pair of guide members 31 are disposed at a retracted position, all ends 31*a* and the other ends 31*b* are disposed outside a discharge area EA (a discharge path) of the paper sheet M in the width direction Y intersecting the discharge direction X1. The folding preventing device 20 drives the pair of guide-movable bodies 32 through the driving mechanisms 34 by power of the electric motors 33. The pair of guide members 31 can be provided to be advanced and retracted between the advanced position (see FIG. 6) where the guide members 31 are advanced from opposite sides in the width direction Y intersecting the discharge direction X1 of the paper sheet M to an inner side (a central side) in the width direction Y and the retracted position (see FIG. 5) where the guide members 31 are retracted to end portion position sides in the width direction Y.

As illustrated in FIG. 5, in a state in which the guide members 31 are located at the retracted position, when the electric motors 33 perform forward rotation driving, the rack members 37 engaged with the pinions 36 move to an upstream side (an upper side in the drawing) in the discharge direction X1. When the rack members 37 move to the upstream side in the discharge direction X1, the guide-movable bodies 32 including the holding members 38 that hold the guide members 31 pivot while the ends 31*a* (see FIGS. 11 and 12) sides of the guide members 31 are taken as the pivotal shafts 41. The pair of guide members 31 pivot such that the other ends 31*b* (the tip ends) thereof approach each other inside the discharge area EA of the paper sheet M, and are disposed at the advanced position illustrated in FIG. 6.

The folding preventing device 20 pivots the pair of guide members 31 between the retracted position illustrated in FIG. 5 and the advanced position illustrated in FIG. 6. As illustrated in FIG. 5, when the paper bundle M1 is not discharged, the pair of guide members 31 are disposed at the retracted position illustrated in FIG. 5 where the guide members 31 are retracted to opposite sides in the width direction Y with respect to the discharge area EA of the paper bundle M1. Meanwhile, when the paper bundle M1 is discharged, the pair of guide members 31 are disposed at the advanced position illustrated in FIG. 6 where the other ends 31*b* are moved to the inner side in the width direction Y with respect to the discharge area EA of the paper bundle M1 and the other ends 31*b* pivot to approach each other. At the advanced position, the other ends 31*b* of the guide members 31 are disposed to a lower side in the vertical direction Z, as compared to the retracted position.

As illustrated in FIG. 6, in a state in which the guide members 31 are located at the advanced position, the holding members 38 that hold and pivot the guide members 31 guide the paper sheet M having a maximum width indicated by a two-dot chain line in the drawing together with the guide members 31. Further, when the guide members 31 move to the advanced position, the guide-movable bodies 32 including the holding members 38 that hold and pivot the guide members 31 move from the retracted position illustrated in FIG. 5 to the upstream side (the upper side in the drawing) in the discharge direction X1, and are disposed at the advanced position illustrated in FIG. 6. Further, when the guide members 31 move to the retracted position, the guide-movable bodies 32 including the holding members 38 move from the advanced position illustrated in FIG. 6 to a downstream side in the discharge direction X1, and are disposed at the retracted position illustrated in FIG. 5.

As illustrated in FIGS. 7 to 10, the electric motor 33 is assembled to a lower portion of the guide frame 35, and the pinion 36 fixed to the output shaft of the electric motor 33 protrudes upward from the guide frame 35. The rack member 37 has a long plate shape elongated in the discharge direction X1, and is assembled to an upper portion of the guide frame 35 to be movable in a direction that is parallel to the discharge direction X1. The rack member 37 has a tooth portion 37*a* (see FIG. 8) engaged with a tooth portion 36*a* of the pinion 36 on a side portion facing the pinion 36.

Figure 7:
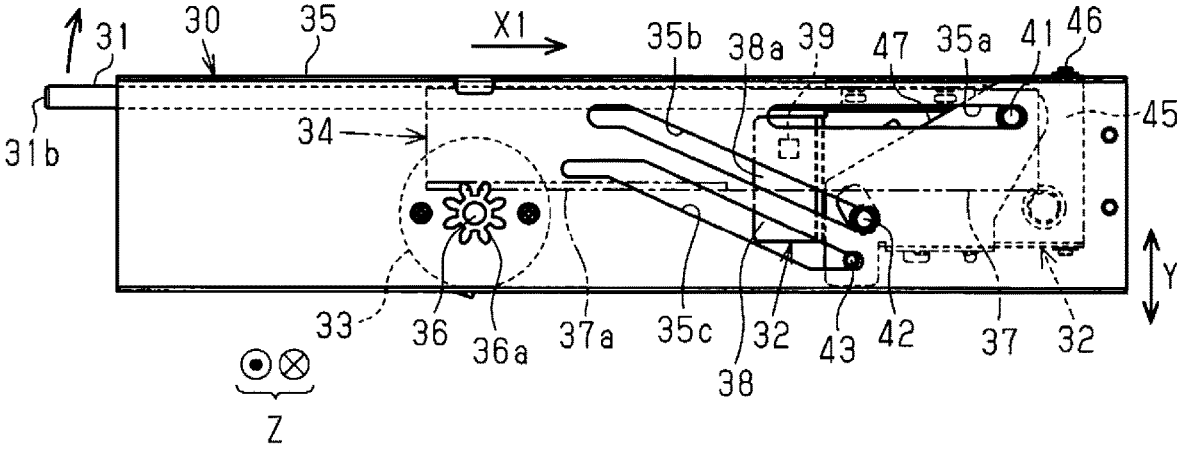
FIG. 7 is a plan view illustrating a guide unit.
Figure 9:
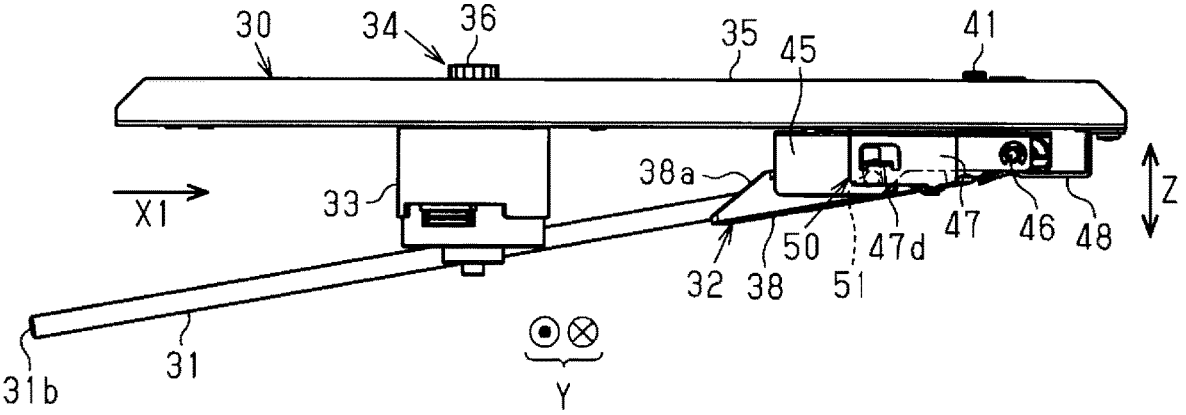
FIG. 9 is a side view illustrating the guide unit when the guide members are located at the advanced position.

As illustrated in FIGS. 7 and 9, the guide-movable body 32 having the guide member 31 is disposed on a lower side of the guide frame 35. The guide-movable body 32 has the pivotal shaft 41, the first guide shaft 42, and the second guide shaft 43 which protrude upward from an upper surface thereof in parallel to each other. As illustrated in FIG. 7, the first guide groove 35*a* extending in a direction that is parallel to the discharge direction X1 is formed in the guide frame 35. The pivotal shaft 41 is inserted through the first guide groove 35*a* and is pivotably connected to the rack member 37.

Further, as illustrated in FIG. 7, a second guide groove 35*b* and a third guide groove 35*c* having groove paths obliquely extending in a direction intersecting the discharge direction X1 at a predetermined angle are formed in the guide frame 35. The first guide shaft 42 is inserted through the second guide groove 35*b*. The second guide shaft 43 is inserted through the third guide groove 35*c*. The second guide groove 35*b* and the third guide groove 35*c* extend substantially in parallel to each other, and the groove paths of the second guide groove 35*b* and the third guide groove 35*c* approach the discharge area EA (see FIG. 5) side (the upper side in FIG. 7) of the paper sheet M as they go from a downstream end side to an upstream end side of the discharge direction X1.

Figure 8:
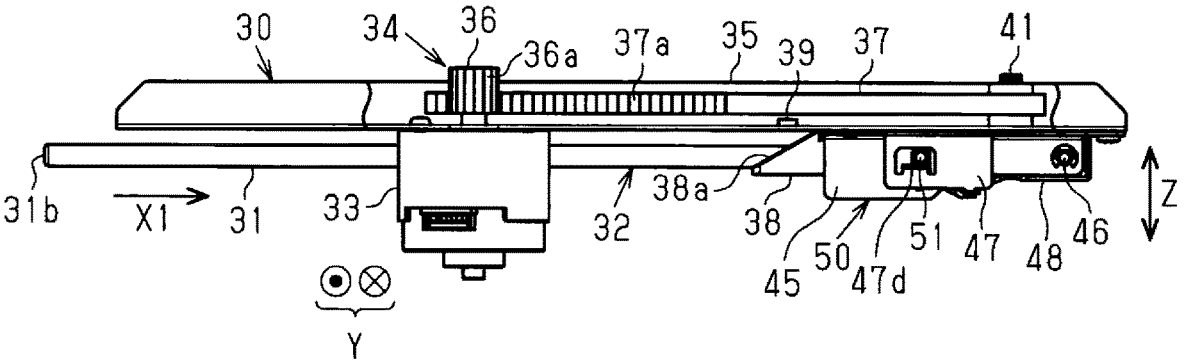
FIG. 8 is a partially cutaway side view illustrating a guide unit.

When the electric motor 33 performs forward rotation driving, the rack member 37 moves from a position where the guide-movable body 32 is retracted as illustrated in FIGS. 5, 7, and 8 to a position where the guide-movable body 32 is advanced as illustrated in FIG. 6. In this process, the pivotal shaft 41 moves to an upstream side of the discharge direction X1 along the first guide groove 35*a*, and the first guide shaft 42 and the second guide shaft 43 move along the second guide groove 35*b* and the third guide groove 35*c* in a direction obliquely intersecting the discharge direction X1, respectively. Therefore, the guide-movable body 32 pivots to the advanced position illustrated in FIGS. 6 and 9 while moving from the retracted position illustrated in FIGS. 5, 7, and 8 to the upstream side of the discharge direction X1.

As illustrated in FIG. 8, the guide-movable body 32 includes the holding member 38 that holds the guide member 31, a base member 45 that supports the holding member 38 tiltably about a support shaft 46, and a locking member 47 that is relatively pivotable about the pivotal shaft 41 in a range of a predetermined angle with respect to the base member 45. The holding member 38 is configured to be tiltable about the support shaft 46 with respect to the base member 45. The holding member 38 is tilted about the support shaft 46 so that the holding member 38 can be disposed in a high posture in which the guide member 31 extends in parallel to the guide frame 35 and the other end 31*b* (the tip end) thereof is disposed at a high position as illustrated in FIG. 8 and in a low posture in which the guide member 31 is tilted downward with respect to the guide frame 35 at a predetermined angle and the other end 31*b* (the tip end) thereof is lowered as illustrated in FIG. 9. When the guide-movable body 32 is disposed at the advanced position (FIG. 9), the other end 31*b* side of the guide member 31 is disposed on the lower side in the vertical direction Z, as compared to a case where the guide member 31 is disposed at the retracted position (FIG. 8). That is, the other end 31*b* of the guide member 31 is disposed at a low position.

Further, as illustrated in FIG. 8, a position sensor 39 that detects a position of the guide-movable body 32 is provided in the guide unit. In an example illustrated in FIG. 8, the position sensor 39 detects the position of the guide-movable body 32 by detecting, for example, a position of the rack member 37. The position sensor 39 is assembled to an upper surface of the guide frame 35 to detect a first detection target portion provided in the rack member 37 to detect the retracted position and a second detection target portion (not illustrated) for detecting the advanced position. When it is detected by the position sensor 39 that the guide-movable body 32 reaches the advanced position while the guide-movable body 32 moves from the retracted position to the advanced position, the forward rotation driving of the electric motor 33 is stopped. Further, when it is detected by the position sensor 39 that the guide-movable body 32 reaches the retracted position while the guide-movable body 32 moves from the advanced position to the retracted position, the reverse rotation driving of the electric motor 33 is stopped.

Figure 10:
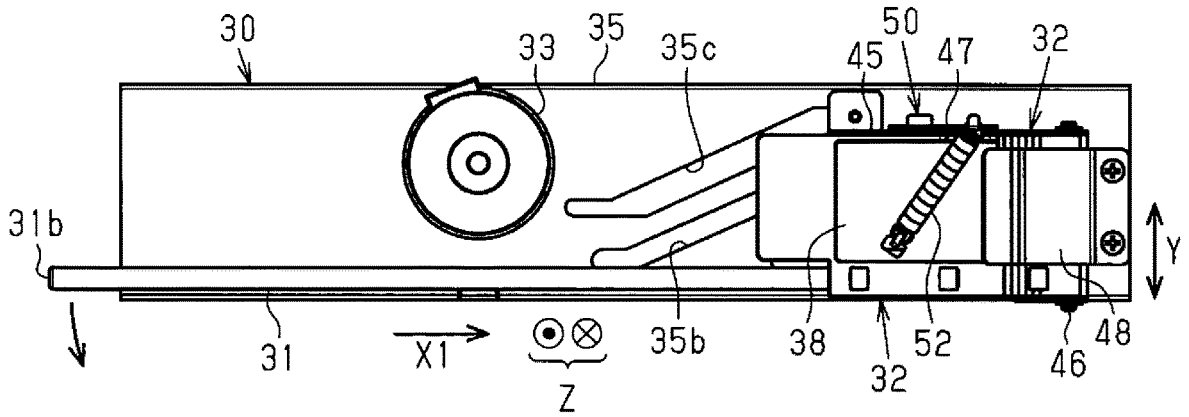
FIG. 10 is a bottom view illustrating the guide unit.
Figure 13:
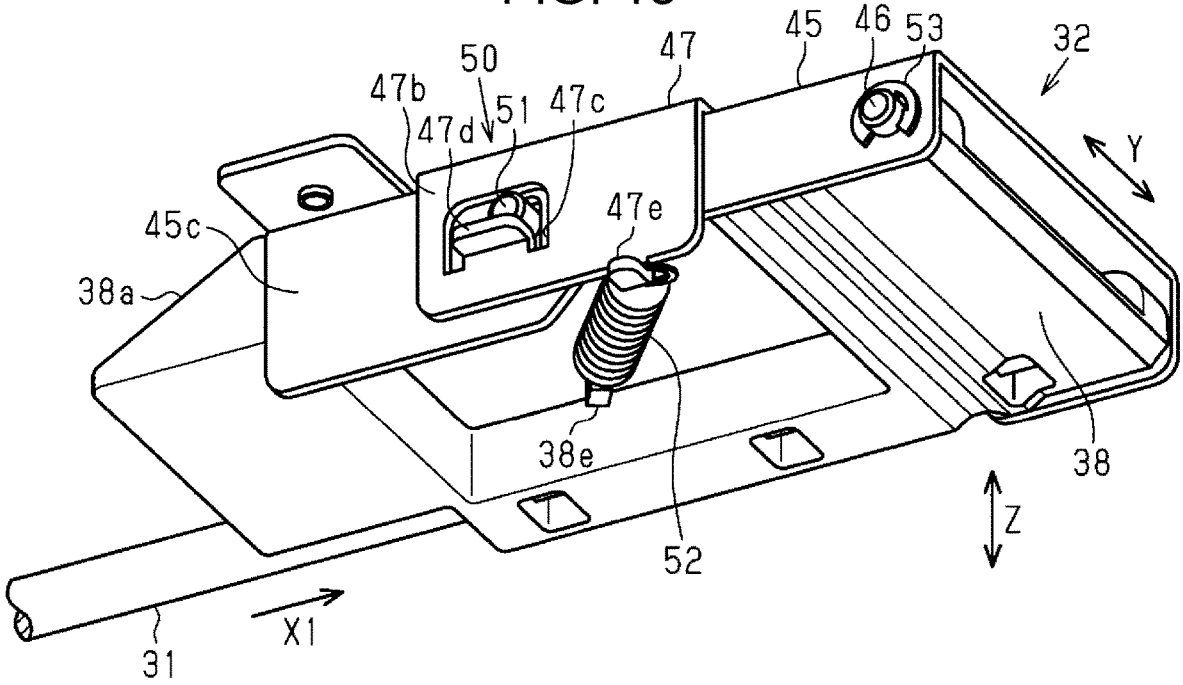
FIG. 13 is a partial perspective view illustrating the guide movable body when viewed from the bottom surface side.

As illustrated in FIGS. 10 and 13, in the guide-movable body 32, the holding member 38 is energized to the lower side in the vertical direction Z by an energization spring 52. Therefore, the holding member 38 is energized to be tilted about the support shaft 46 from the high position illustrated in FIG. 8 to the low position illustrated in FIG. 9, by an energization force of the energization spring 52.

As illustrated in FIGS. 8 and 10, a reset member 48 formed with a substantially L-shaped plate when viewed from a side surface of FIG. 8 is fixed to a downstream side end portion of a lower surface of the guide frame 35 in the discharge direction X1. In a state in which the guide-movable body 32 is located at the retracted position, a downstream side end portion (a base end portion) of the holding member 38 in the discharge direction X1 is inserted and fitted into the reset member 48, so that the holding member 38 is held in the high position illustrated in FIG. 8 in which the guide member 31 lifts up the other end 31*b* (the tip end).

Figure 14:
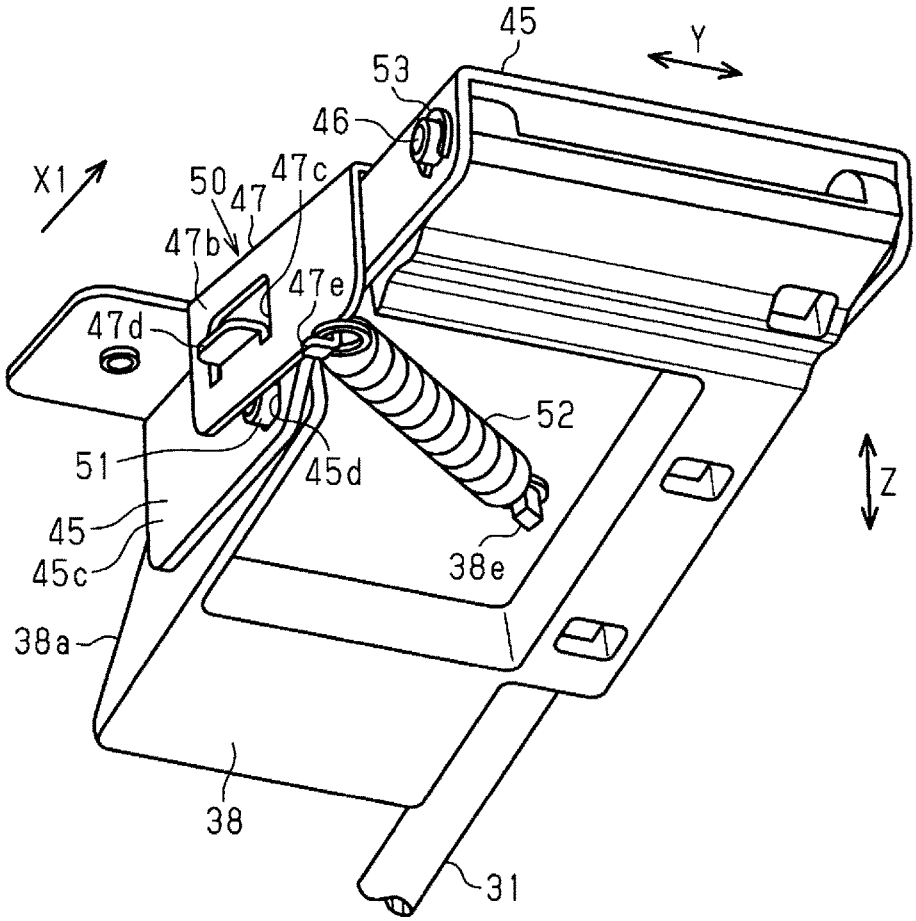
FIG. 14 is a partial perspective view illustrating the guide movable body in an unlocked state when viewed from the bottom surface side.

Further, as illustrated in FIG. 8, the guide-movable body 32 includes a locking mechanism 50 that holds the holding member 38 in the high posture to a slightly front position in which movement to the advanced position is terminated even when the holding member 38 is separated from the reset member 48 while the guide-movable body 32 moves from the retracted position to the advanced position. The locking mechanism 50 prevents the holding member 38 from being tilted from the high posture to the low posture against the energization force of the energization spring 52 even when the base end portion of the holding member 38 is separated from the reset member 48 while the guide-movable body 32 moves from the retracted position to the advanced position. The locking mechanism 50 has a locking pin 51 protruding from a side surface of the holding member 38 and a regulation portion 47*d* in contact with the locking pin 51. As illustrated in FIGS. 8 and 13, the holding member 38 is held in the high posture while the locking pin 51 and the regulation portion 47*d* are in contact with each other. As illustrated in FIGS. 9 and 14, when the contact between the locking pin 51 and the regulation portion 47*d* is released, the holding member 38 is tilted from the high posture to the low posture by the energization force of the energization spring 52.

Further, as illustrated in FIGS. 8 and 9, a tip end portion of the reset member 48 is expanded and opened to be spaced apart from the guide frame 35, the insertion of the base end portion of the holding member 38 into the reset member 48 can be guided by the expanded and opened portion. While the guide-movable body 32 returns from the advanced position illustrated in FIG. 9 to the retracted position illustrated in FIG. 8, the base end portion of the holding member 38 is inserted between the reset member 48 and the guide frame 35, so that the holding member 38 is guided to the reset member 48 to return from the low posture to the high posture. The locking mechanism 50 will be described below.

Figure 11:
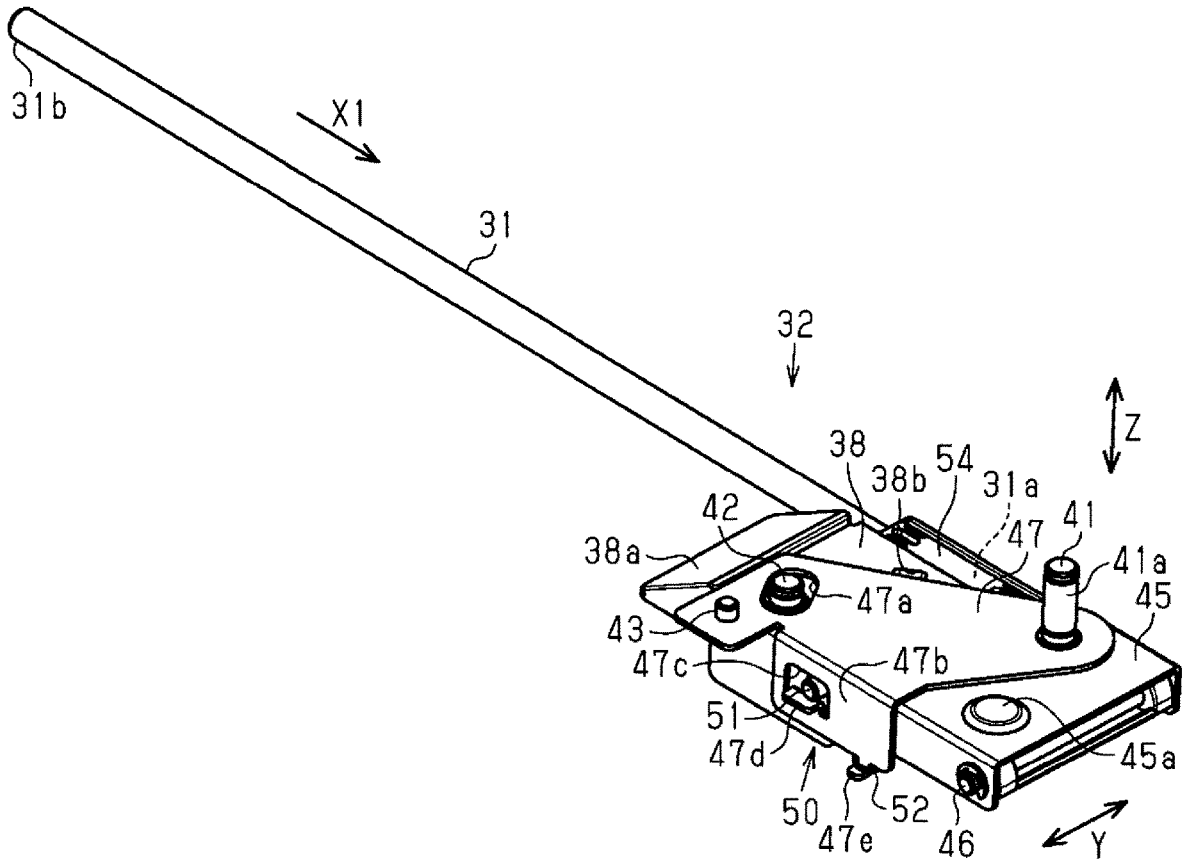
FIG. 11 is a perspective view illustrating a guide movable body when viewed from the upper surface side.
Figure 12:
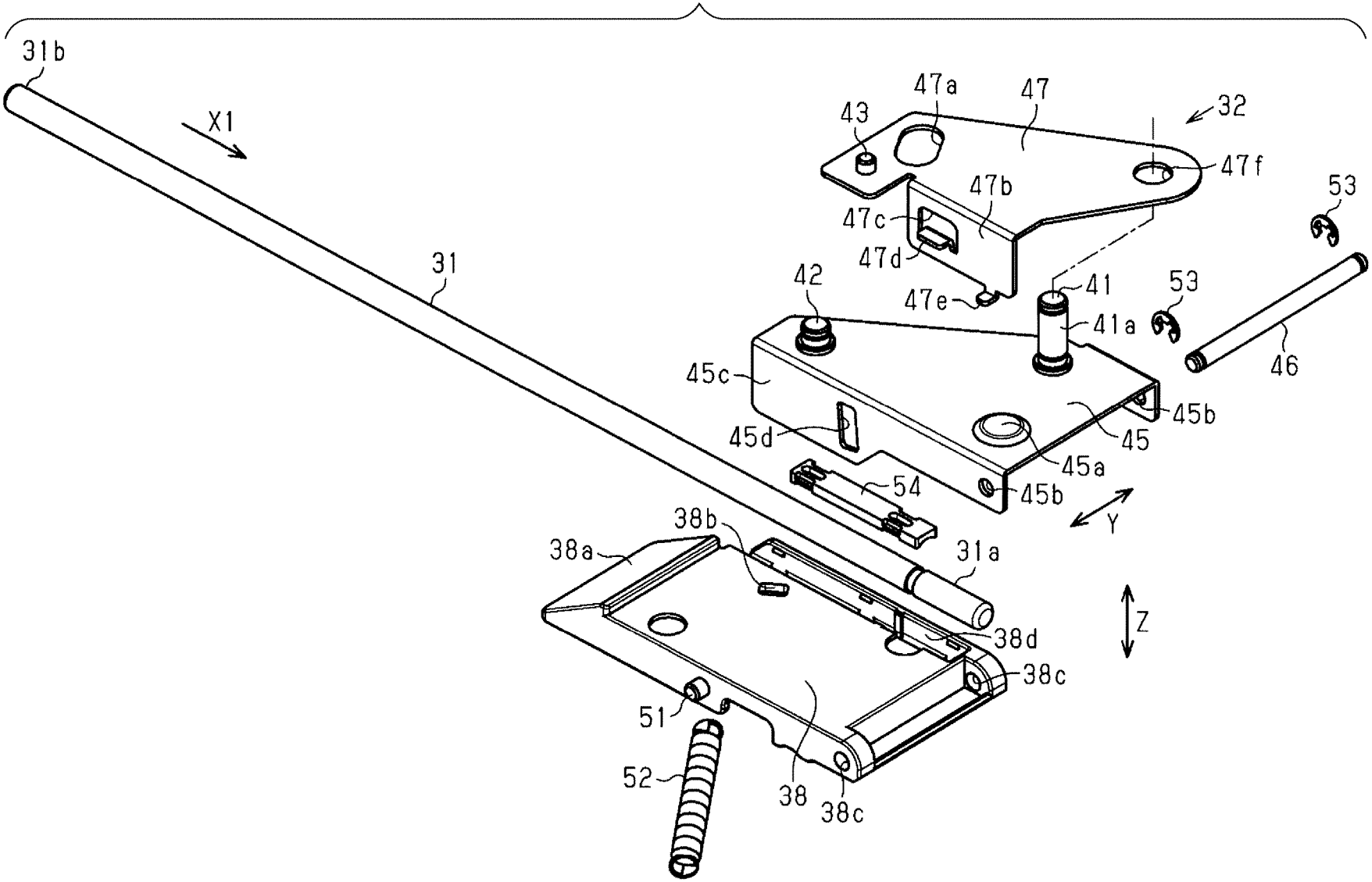
FIG. 12 is an exploded perspective view illustrating the guide movable body.

Next, a configuration of the guide-movable body 32 will be described with reference to FIGS. 11 to 14. As illustrated in FIGS. 11 and 12, the guide-movable body 32 is configured by assembling components such as the holding member 38, the rod-shaped guide member 31 held in the holding member 38, the base member 45 formed with a bent metal plate, and the locking member 47 formed with a bent metal plate. The holding member 38 can be tilted about the support shaft 46 inserted through one end portion of the base member 45 with respect to the base member 45. Further, as illustrated in FIG. 12, the locking member 47 is assembled to cover an upper surface or a part of a side surface of the base member 45. The locking member 47 can be pivoted about the pivotal shaft 41 within a predetermined range relatively to the base member 45. The first guide shaft 42 vertically protruding from the upper surface of the base member 45 is inserted through a guide hole 47*a* opened on an upper surface of the locking member 47. Therefore, the locking member 47 can be relatively pivoted about the pivotal shaft 41 relatively to the base member 45 within a range in which the first guide shaft 42 can move within the guide hole 47*a*. Further, the pivoting of the locking member 47 to one side is regulated by contact with a convex portion 38*b* protruding from the upper surface of the holding member 38. Further, the second guide shaft 43 vertically protrudes from an end of the upper surface of the locking member 47 separated further from the pivotal shaft 41 than the first guide shaft 42.

The locking mechanism 50 that regulates the downward tilting of the holding member 38 about the support shaft 46 includes the locking pin 51 protruding from a side portion of the holding member 38, the locking member 47 that can be pivoted about the pivotal shaft 41 with respect to the base member 45 within a range of a predetermined angle, and the regulation portion 47*d* that can be in contact with the locking pin 51. As the locking pin 51 of the holding member 38 comes into contact with the guide hole 45*d* of the base member 45, which is opened in a side plate portion 45*c* covering a side portion of the holding member 38, and the regulation portion 47*d* of the locking member 47, which is exposed from a window portion 47*c* opened in a side plate portion 47*b* covering the side portion of the holding member 38 and protrudes from a lower side of the window portion 47*c*, the locking pin 51 locks the holding member 38 such that the holding member 38 cannot be tilted downward.

Further, as illustrated in FIGS. 12 to 14, the energization spring 52 is stretched in a state in which opposite end portions thereof are locked by a protrusion portion 47*e* formed at a lower end portion of the side plate portion 47*b* of the locking member 47 and a protrusion portion 38*e* formed at a predetermined position on a rear surface of the holding member 38. The holding member 38 that holds the guide member 31 is energized in a downward direction in which the holding member 38 is tilted about the support shaft 46 from the high posture to the low posture, by the energization force of the energization spring 52. Further, the holding member 38 is energized in a direction (a retracting direction) in which the holding member 38 pivots about the pivotal shaft 41 from the advanced position to the retracted position, by the energization force of the energization spring 52. Energization to pivot the holding member 38 to the outside in the width direction Y and energization to downward tilt the holding member 38 may be performed using separate springs.

Further, as illustrated in FIGS. 8 and 11, a guide surface 38*a* formed with an inclined surface is formed on an upstream side end portion of the holding member 38 in the discharge direction X1. The guide surface 38*a* supports the paper sheet M, the width of which is wide, such as the paper sheet M having a maximum width, together with the guide member 31. When the paper sheet M having the maximum width is supported only by the guide member 31, it is necessary that the holding member 38 is disposed outside the discharge area of the paper sheet M having the maximum width in the width direction Y. In this case, it is necessary to increase an interval between the guide units 30 in the width direction, leading to an increase in the size of the folding preventing device 20. Therefore, as a part of the holding member 38 is disposed inside the discharge area of the paper sheet M having a maximum width in the width direction Y and opposite side end portions of the paper sheet M having a maximum width in the width direction Y are guided by the guide surface 38*a* of the holding member 38, which is formed with an inclined surface, the interval between the pair of guide units 30 in the width direction Y becomes relatively narrow, and the increase in the size of the folding preventing device 20 is prevented. Further, a convex portion 45*a* provided on an upper surface of the base member 45 slides on the lower surface of the guide frame 35 to suppress rattling of the guide-movable body 32.

As illustrated in FIGS. 11 and 12, the pivotal shaft 41 has a shaft 41*a*. The pivotal shaft 41 is inserted through a shaft hole 47*f* formed in the locking member 47 and is pivotably connected to the rack member 37 through the shaft 41*a*. The support shaft 46 is inserted through a shaft hole 45*b* of the base member 45 and a shaft hole 38*c* of the holding member 38, and separation of opposite end portions of the support shaft 46 is prevented by a pair of retaining rings 53.

Further, as illustrated in FIGS. 12 and 13, an elongated guide hole 45*d* is formed at a position of the side plate portion 45*c* of the base member 45, which corresponds to the locking pin 51 of the holding member 38. The locking pin 51 is inserted through the guide hole 45*d* and the window portion 47*c* and is in contact with the regulation portion 47*d*. Further, as illustrated in FIG. 12, a concave portion 38*d* that holds the guide member 31 is formed in an upper surface side edge portion of the holding member 38. When a base end portion of the one end 31*a* of the guide member 31 is inserted into the concave portion 38*d*, a cover 54 is locked by an upper portion of the guide member 31, so that the guide member 31 is held in the holding member 38.

Figure 18:
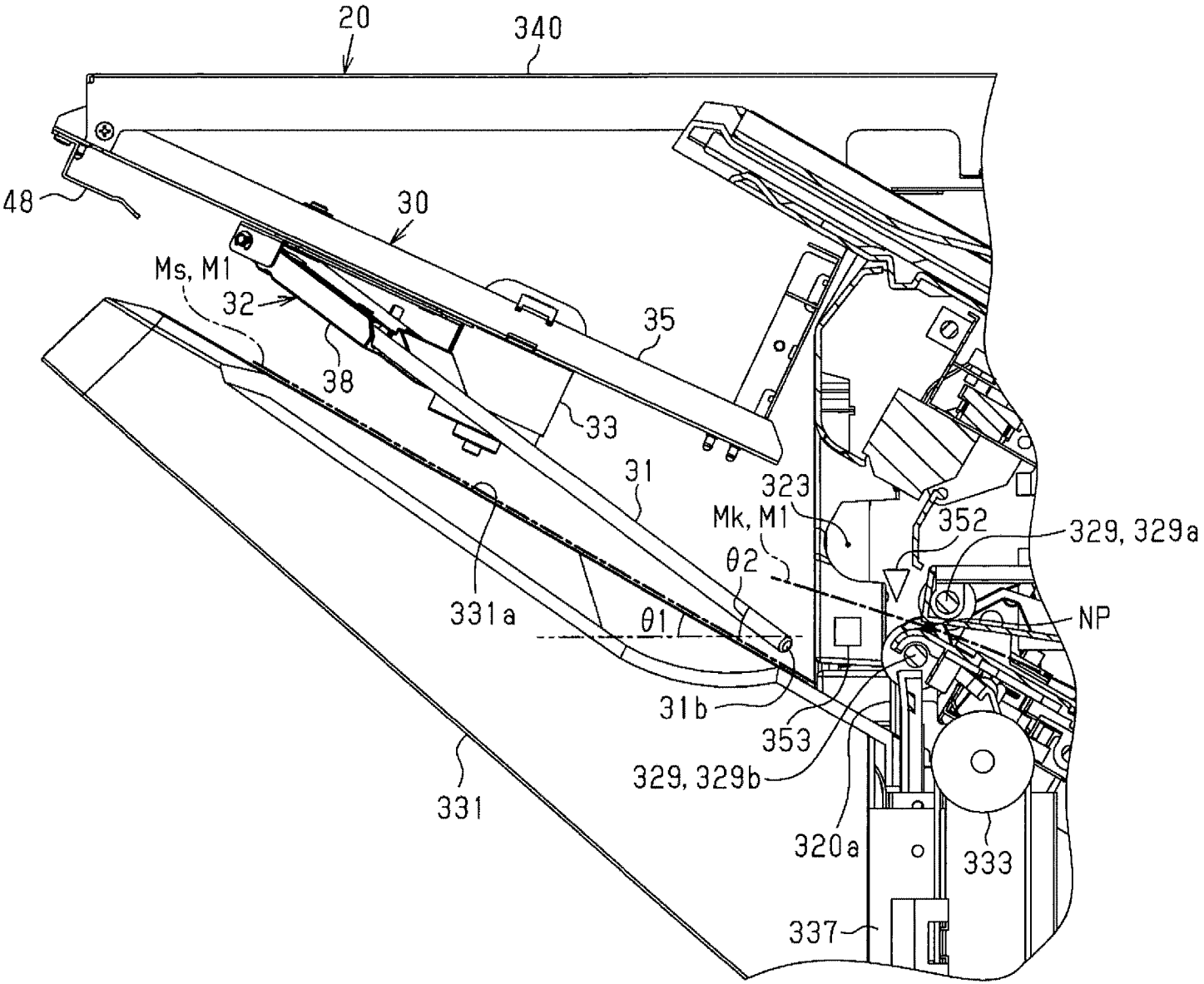
FIG. 18 is a side view illustrating the folding preventing device and a discharge tray when the guide members are located at the advanced position.

FIG. 18 illustrates a state in which the pair of guide members 31 are disposed at the advanced position. As illustrated in the drawing, when the guide member 31 is disposed at the advanced position, the other end 31*b* side of the guide member 31 is disposed between a nip position NP which is the discharge position by the discharge roller pair 329 and a position of an upper surface (a preceding paper sheet upper surface) of a preceding paper sheet Ms (a preceding medium) previously discharged and placed on the discharge tray 331, in the vertical direction Z. Further, when there is no preceding paper sheet Ms, that is, when the discharge tray 331 is at an uppermost position, if the guide member 31 is disposed at the advanced position, the other end 31*b* side of the guide member 31 is disposed between the discharge position by the discharge roller pair 329 and a position of the placement surface 331*a* of the discharge tray 331, in the vertical direction Z. As illustrated in FIG. 4, when the guide member 31 is located at the retracted position, the other end 31*b* of the guide member 31 is located above the discharge position by the discharge roller pair 329 in the vertical direction Z.

A following paper sheet Mk discharged from the discharge roller pair 329 and illustrated in FIG. 18 slides on upper surfaces of the pair of guide members 31 disposed at the advanced position to move to a downstream side of the discharge direction X1. The folding preventing device 20 supports the following paper sheet Mk discharged from the discharge roller pair 329 by the pair of guide members 31 before the following paper sheet Mk comes into contact with an upper surface of the preceding paper sheet Ms on the discharge tray 331. After an upstream end (a rear end) of the following paper sheet Mk in the discharge direction X1 is discharged from the discharge roller pair 329, the pair of guide members 31 are pulled out from a lower side of the following paper sheet Mk, and the following paper sheet Mk is dropped onto the upper surface of the preceding paper sheet Ms previously placed on the discharge tray 331, so that downward folding is suppressed.

The guide members 31 are members having flexibility and formed of a material (for example, a resin material such as polyethylene terephthalate) having a low surface friction coefficient with respect to the paper sheet M and having abrasion resistance. In the present embodiment, the friction coefficient of the guide members 31 with respect to the paper sheet M is set to be less than the friction coefficient of the placement surface 331*a* of the discharge tray 331 with respect to the paper sheet M.

Further, when the guide members 31 are located at the advanced position, the other ends 31*b* of the guide members 31 are located on an upstream side in the discharge direction X1 from a position where the tip ends, which correspond to a downstream side of the discharged paper bundle M1 in the discharge direction X1, firstly come into contact with the upper surface of the preceding paper sheet Ms, in a state in which there is no guide member 31. The position condition of the guide members 31 is set assuming a paper type (for example, the "plain paper"), which is easily bent downward due to a self-weight thereof when being discharged and has a relatively small thickness, among the paper sheets M used for printing. In the present embodiment, when the guide members 31 are located at the advanced position, the other ends 31*b* (the tip ends) of the pair of guide members 31 are located on a slightly downstream side of the regulation wall 320*a* in the discharge direction X1.

Further, as illustrated in FIG. 18, when the guide member 31 is disposed at the advanced position, an inclination of the guide member 31 is more than that of the placement surface 331*a* of the discharge tray 331. An angle θ1 between the placement surface 331*a* of the discharge tray 331 and a horizontal plane, that is, an inclination angle of the placement surface 331*a*, is set to an angle at which the paper sheet M discharged onto the placement surface 331*a* slides on the placement surface 331*a* due to a self-weight thereof and an upstream end (a rear end) of the paper sheet M in the discharge direction X1 comes into contact with the regulation wall 320*a* so that the paper sheet M is positioned. An angle θ2 between a surface (an upper surface) on which the guide member 31 located at the advanced position receives the paper sheet M and the horizontal plane is set to be more than the angle θ1 between the placement surface 331*a* and the horizontal surface. Therefore, the angle θ2 is more than an angle between the upper surface of the preceding paper sheet Ms placed on the placement surface 331*a* and the horizontal plane. As the angle θ2 is set as described above, the following paper sheet Mk received by the guide member 31 slides on the upper surface of the guide member 31 to the upstream side in the discharge direction X1, and the rear end of the following paper sheet Mk comes into contact with the regulation wall 320*a*, so that the following paper sheet Mk can be positioned in the discharge direction X1. Further, in the present embodiment, an extending direction of the guide member 31 toward the upstream side in the discharge direction X1 is directed to a position where the placement surface 331*a* and the regulation wall 320*a* intersect each other. The angle θ2 between the upper surface of the guide member 31 located at the advanced position and the horizontal plane may be equal to or more than the angle θ1 between the placement surface 331*a* and the horizontal surface.

Figure 15:
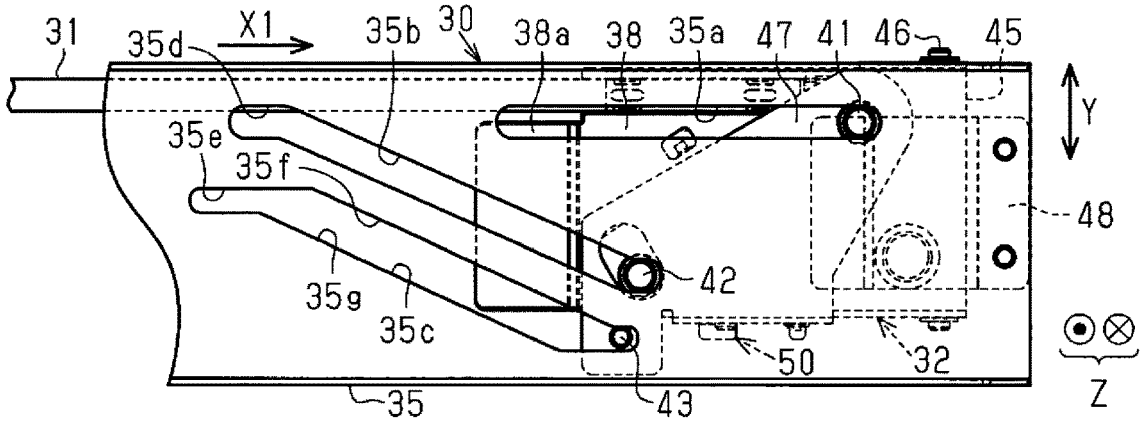
FIG. 15 is a plan view illustrating a state in which the guide movable body is located at the retracted position.
Figure 16:
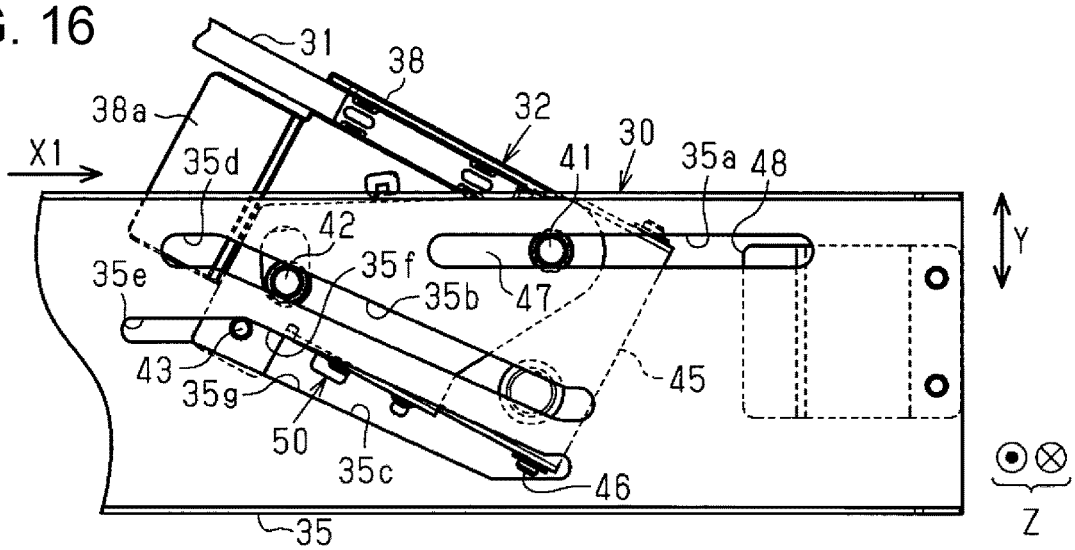
FIG. 16 is a plan view illustrating a process in which the guide movable body moves to the advanced position.
Figure 17:
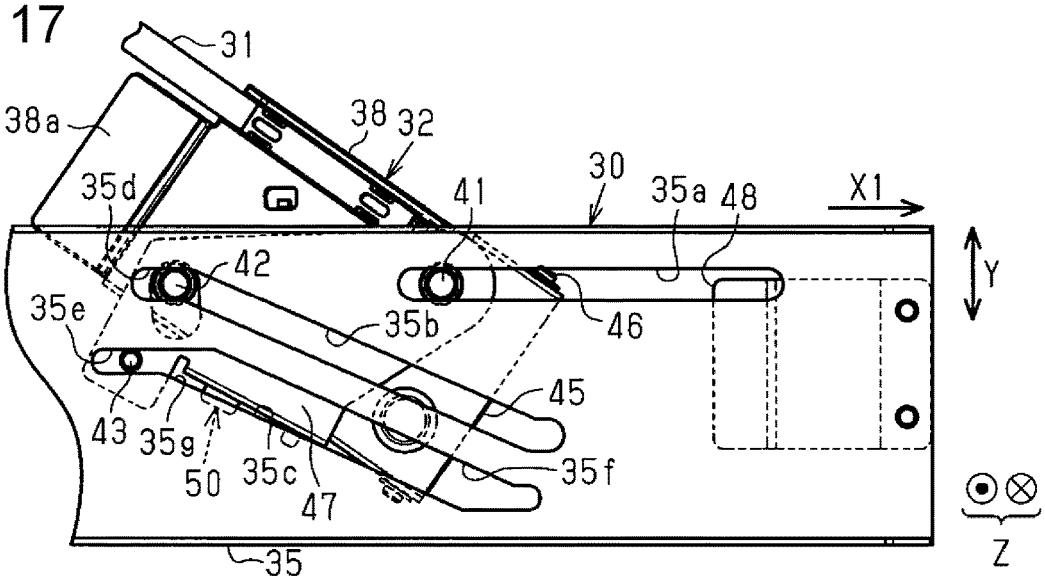
FIG. 17 is a plan view illustrating a state in which the guide movable body is located at the advanced position.

Next, an operation of the guide-movable body 32 will be described with reference to FIGS. 15 to 17. As illustrated in FIGS. 15 to 17, the first guide groove 35*a*, through which a pivotal shaft 41 is inserted, linearly extends in parallel to the discharge direction X1. The second guide groove 35*b* and the third guide groove 35*c*, through which the two guide shafts 42 and 43 separated from the pivotal shaft 41 are inserted, respectively, extend in parallel to each other in a direction intersecting the discharge direction X1 at a predetermined angle. The second guide groove 35*b* and the third guide groove 35*c* have terminal groove portions 35*d* and 35*e* bent at a portion on the upstream side of the discharge direction X1 and extending in parallel to the discharge direction X1. The groove widths of the first guide groove 35*a* and the second guide groove 35*b* are slightly larger than the shaft diameters of the pivotal shaft 41 and the first guide shaft 42, respectively. Further, the groove width of a portion of the third guide groove 35*c*, intersecting the discharge direction X1 and extending obliquely, is sufficiently (two times to three times) larger than the shaft diameter of the second guide shaft 43, and the third guide groove 35*c* has a guide edge 35*f* and a guide edge 35*g* on opposite sides of the groove width thereof.

As illustrated in FIG. 15, in a state in which the guide member 31 is disposed at the retracted position, the guide-movable body 32 is disposed at a downstream side end portion of the discharge direction X1. In this retracted position, the pivotal shaft 41 is located at a downstream side end portion of the first guide groove 35*a* in the discharge direction X1, and the first guide shaft 42 and the second guide shaft 43 are located at downstream side end portions of the second guide groove 35*b* and the third guide groove 35*c* in the discharge direction X1, respectively. When the guide member 31 is located at the retracted position, the position sensor 39 detects the first detection target portion of the rack member 37.

When the electric motor 33 performs the forward rotation driving, the guide-movable body 32 moves from the retracted position illustrated in FIG. 15 to the advanced position illustrated in FIG. 17 toward the upstream side of the discharge direction X1. In the movement process, as illustrated in FIG. 16, the pivotal shaft 41 moves to the upstream side of the discharge direction X1 along the first guide groove 35*a*, and the first guide shaft 42 and the second guide shaft 43 move to the upstream side along an oblique direction intersecting the discharge direction X1 at a predetermined angle along the second guide groove 35*b* and the third guide groove 35*c*, respectively. Thus, in this movement process, the guide-movable body 32 pivots toward the inside of the discharge area EA (see FIG. 5) in the width direction Y. In this movement process, since the locking by the locking mechanism 50 is maintained as illustrated in FIG. 13, the holding member 38 maintains the high posture. Therefore, the guide member 31 moves to a completely advanced position while the other end 31*b* thereof is maintained in the high position. In this movement process, the second guide shaft 43 moves along the guide edge 35*f* inside the third guide groove 35*c*.

As illustrated in FIG. 17, a timing at which the second guide shaft 43 reaches the terminal groove portion 35*e* is slightly later than a timing at which the first guide shaft 42 reaches the terminal groove portion 35*d*. In this delaying process, a distance between the first guide shaft 42 and the second guide shaft 43 increases. Accordingly, the locking member 47 pivots about the pivotal shaft 41 relatively to the outside in the width direction Y with respect to the base member 45. In this relative pivoting, as illustrated in FIG. 14, the side plate portion 47*b* of the locking member 47 is spaced apart from the side plate portion 45*c* of the base member 45, and the locking pin 51 is separated from the regulation portion 47*d*. When the locking by the locking mechanism 50 is released, the holding member 38 is tilted about the support shaft 46 to the lower side by the energization force of the energization spring, and a posture of the holding member 38 is changed from the high posture to the low posture. Therefore, the guide member 31 is lowered to the completely advanced position, and the other end 31*b* thereof is disposed at the low position. When the other end 31*b* of the guide member 31 finishes the lowering at the completely advanced position, the position sensor 39 (see FIG. 8) detects the second detection target portion of the rack member 37, and finishing of the movement of the guide member 31 to the advanced position is detected. Accordingly, the forward rotation driving of the electric motor 33 is stopped.

Meanwhile, in a state illustrated in FIG. 17 in which the guide member 31 is located at the advanced position, when the electric motor 33 performs the reverse rotation driving, the guide-movable body 32 moves from the advanced position toward the downstream side end portion of the discharge direction X1. At this time, the pivotal shaft 41 moves toward the downstream side of the discharge direction X1 along the first guide groove 35*a*, and the first guide shaft 42 and the second guide shaft 43 move toward the downstream side of the discharge direction X1 along the second guide groove 35*b* and the third guide groove 35*c*, respectively. Therefore, the guide-movable body 32 pivots toward the outside of the discharge area EA in the width direction Y. In this movement process, since the holding member 38 is located in the low posture due to the energization force of the energization spring 52, the locking pin 51 protruding from the side surface of the holding member 38 comes into contact with a lower portion of the side plate portion 47*b* of the locking member 47 and is maintained in an unlocked state. Therefore, the holding member 38 is maintained in the low posture. In this movement process, the second guide shaft 43 moves along the guide edge 35*g* outside the third guide groove 35*c*.

Immediately before the guide-movable body 32 reaches a downstream end position of the discharge direction X1, the base end portion of the holding member 38 is guided and inserted into the reset member 48. In this insertion process, the holding member 38 tilts about the support shaft 46 to the upper side, and the posture of the holding member 38 is changed from the low posture illustrated in FIG. 14 to the high posture illustrated in FIG. 13. As a result, the other end 31*b* rises from the low position to the high position at a completely retracted position of the guide member 31. Due to the upward tilting of the holding member 38, the locking pin 51 protruding from the side surface of the holding member 38 as illustrated in FIG. 13 is inserted into the window portion 47*c* opened in the side plate portion 47*b* of the locking member 47 and is locked by coming into contact with the regulation portion 47*d*.

Figure 19:
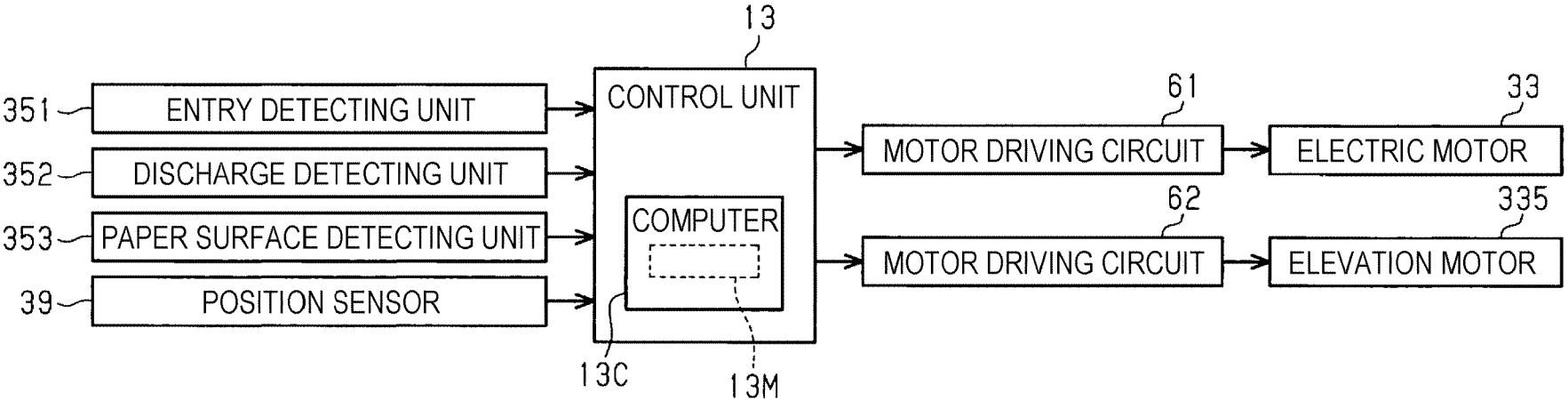
FIG. 19 is a block diagram illustrating an electrical configuration of a part relating to folding prevention control in the post-processing device.
Figure 20:
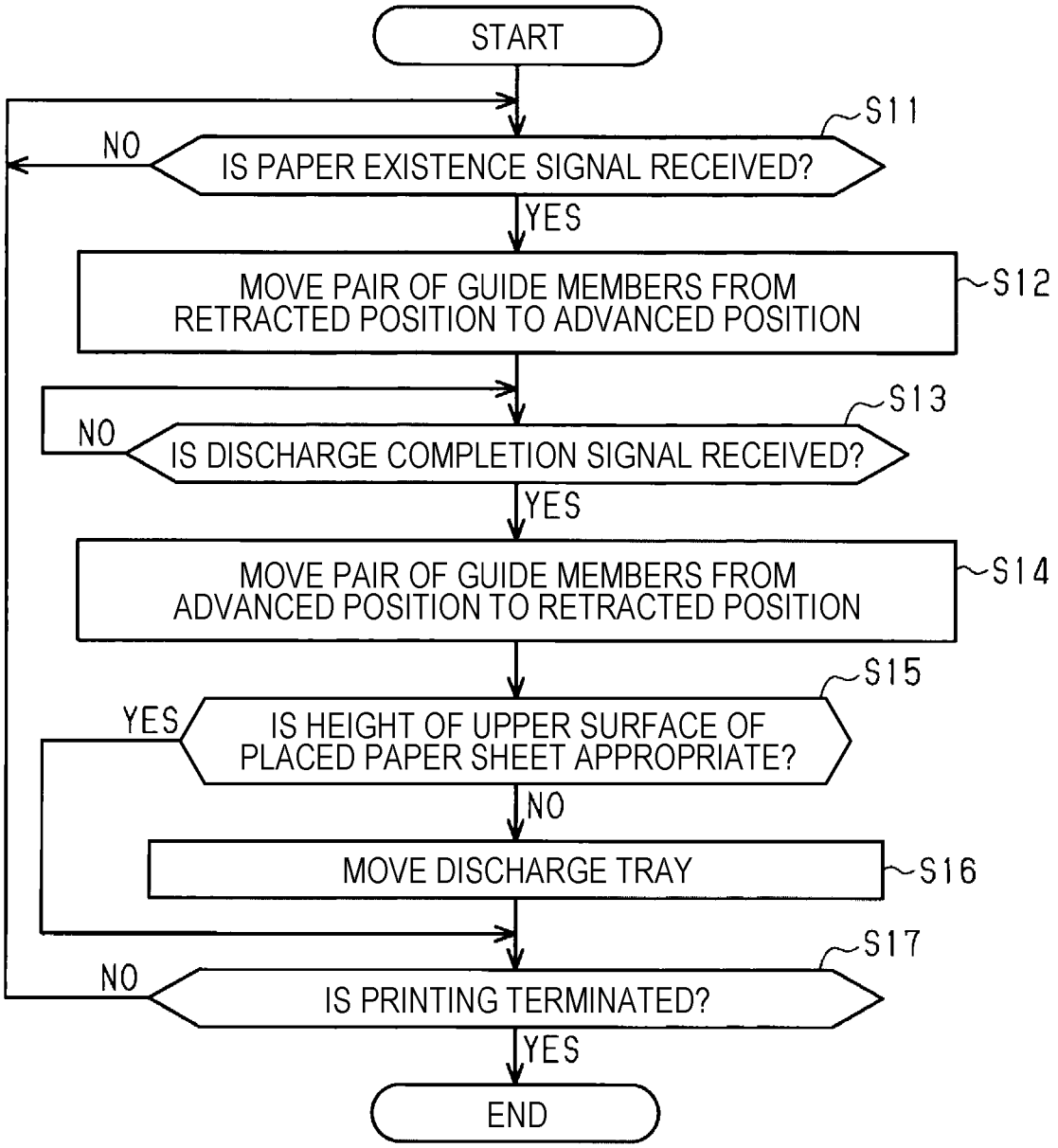
FIG. 20 is a flowchart illustrating a folding preventing control routine.

Next, an electric configuration of a constituent element related to control of the folding preventing device 20 in the post-processing device 300 will be described with reference to FIG. 19. As illustrated in FIG. 19, the entry detecting unit 351, the discharge detecting unit 352, the paper surface detecting unit 353, and the position sensor 39 as an input system are electrically connected to the control unit 13. Further, the electric motor 33 as an output system is electrically connected to the control unit 13 through a motor driving circuit 61, and the elevation motor 335 as the output system is electrically connected to the control unit 13 through a motor driving circuit 62. The control unit 13 includes a computer 13C. A program for folding preventing control illustrated in a flowchart of FIG. 20 is stored in a storage unit 13M of the computer 13C. The computer 13C executes the program stored in the storage unit 13M to drive and control the folding preventing device 20.

When the entry detecting unit 351 detects the entering paper sheet M, the control unit 13 causes the electric motor 33 to perform the forward rotation driving so as to pivot the guide member 31 from the retracted position to the advanced position. Therefore, before the paper bundle M1 is discharged from the discharge roller pair 329, the guide member 31 pivots from the retracted position to the advanced position. Further, the control unit 13 starts counting from a detection time point when the discharge detecting unit 352 detects the paper bundle M1, and causes the electric motor 33 to perform the reverse rotation driving, when the counting reaches a predetermined value, so as to pivot the guide member 31 from the advanced position to the retracted position. Therefore, in a state in which the paper bundle M1 is discharged from the discharge roller pair 329 and a rear end portion of the paper bundle M1 comes into contact with the upper surface of the preceding paper sheet Ms, the guide member 31 pivots from the advanced position to the retracted position.

If the guide member 31 can be moved from the retracted position to the advanced position before the paper bundle M1 is discharged from the discharge roller pair 329, a detection signal of another detecting unit (a sensor) may be used as a trigger for starting an advancing operation. Further, if the guide member 31 is moved from the advanced position to the retracted position after the paper bundle M1 is discharged from the discharge roller pair 329, the detection signal of the another detecting unit may be used as a trigger for starting a retracting operation. In this case, the sensor used for the trigger for starting an advancing operation and the trigger for starting a retracting operation may be different or may be the same.

Next, operations of the printing apparatus 10 and the folding preventing device 20 will be described. When the printing apparatus 10 is turned on, the control unit 13 executes the folding preventing control illustrated in the flowchart of FIG. 20. In detail, printing is started in the image forming device 100. The paper sheet M is transported and is printed at a printing position in the middle of the transport path thereof by the recording head, and the paper sheet M after the printing is transported along the discharge path by the discharge roller and is discharged from the image forming device 100 to the intermediate transporting device 200 through a discharge port connected to the intermediate transporting device 200. At this time, the paper sheet M is discharged in a state in which a printed surface is disposed as an upper surface. In the intermediate transporting device 200, the paper sheet M is reversed, and the reversed paper sheet M is discharged to the post-processing device 300. The paper sheet M enters the post-processing device 300 in a state in which the printed surface thereof is disposed as an upper surface. The paper sheet M entering the post-processing device 300 is detected by the entry detecting unit 351. In the post-processing device 300, the post-processed paper bundle M1 is discharged from the discharge roller pair 329. When the paper bundle M1 is discharged from the discharge roller pair 329, a tip end of the paper bundle M1 is detected by the discharge detecting unit 352.

Hereinafter, the folding preventing control performed by the computer 13C of the control unit 13 will be described with reference to the flowchart illustrated in FIG. 20 and FIGS. 21 to 26. Further, in FIGS. 21 to 26, the paper bundle M1 previously discharged and loaded on the placement surface 331*a* of the discharge tray 331 is set as the preceding paper sheet Ms (an example of the preceding medium) and the paper bundle M1 to be discharged after the preceding paper sheet Ms is set as the following paper sheet Mk (an example of the following medium). When the control unit 11 is configured to control the printing apparatus 10 in an integrated manner, the computer of the control unit 11 may control the following folding preventing control.

First, in step S11, the computer 13C determines whether or not a paper existence signal is received. If the paper existence signal is received, the computer 13C proceeds to step S12, and if the paper existence signal is not received, the computer 13C waits until the paper existence signal is received. Here, the paper existence signal is a signal serving as a trigger of starting an operation of the folding preventing device 20, and is a signal obtained when a first detection unit detects the paper sheet M. In this example, the paper existence signal is a detection signal output when the entry detection unit 351 (the first detection unit) detects the paper sheet M.

In step S12, the computer 13C moves the pair of guide members 31 from the retracted position to the advanced position. In detail, the computer 13C causes the electric motors 33 to perform the forward rotation driving so as to move the pair of guide members 31 from the retracted position to the advanced position. When the electric motors 33 perform the forward rotation driving, the rack members 37 move to the upstream side of the discharge direction X1. According to this movement, the pivotal shafts 41, the first guide shafts 42, and the second guide shafts 43 move to the upstream side of the discharge direction X1 along the guide grooves 35*a*, 35*b*, and 35*c*. Accordingly, while the guide-movable bodies 32 move to the upstream side of the discharge direction X1, the other ends 31*b* pivot about the pivotal shafts 41 toward the inside of the discharge area EA.

Figure 21:
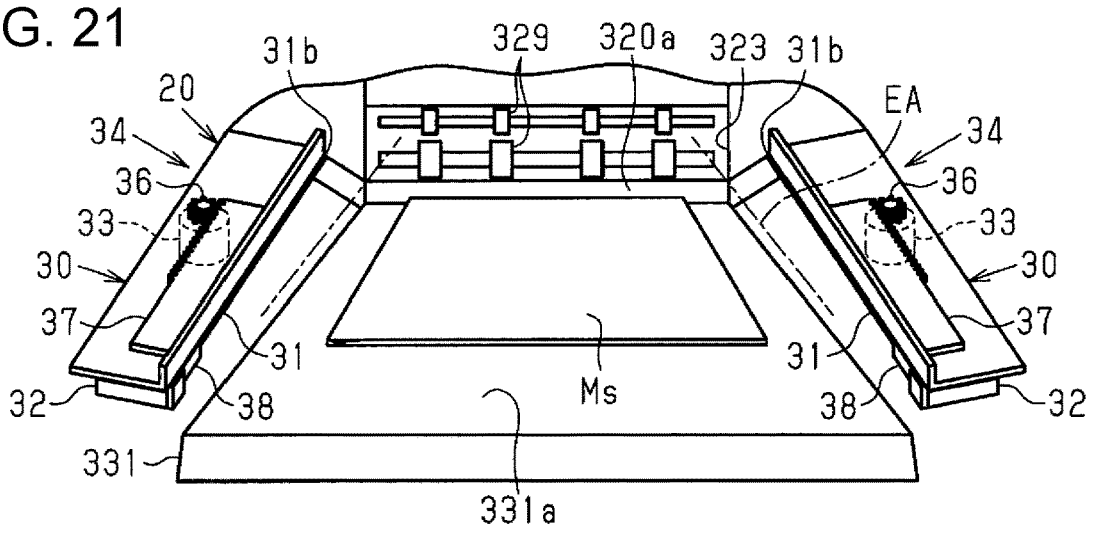
FIG. 21 is a perspective view for illustrating an operation of the folding preventing device.
Figure 22:
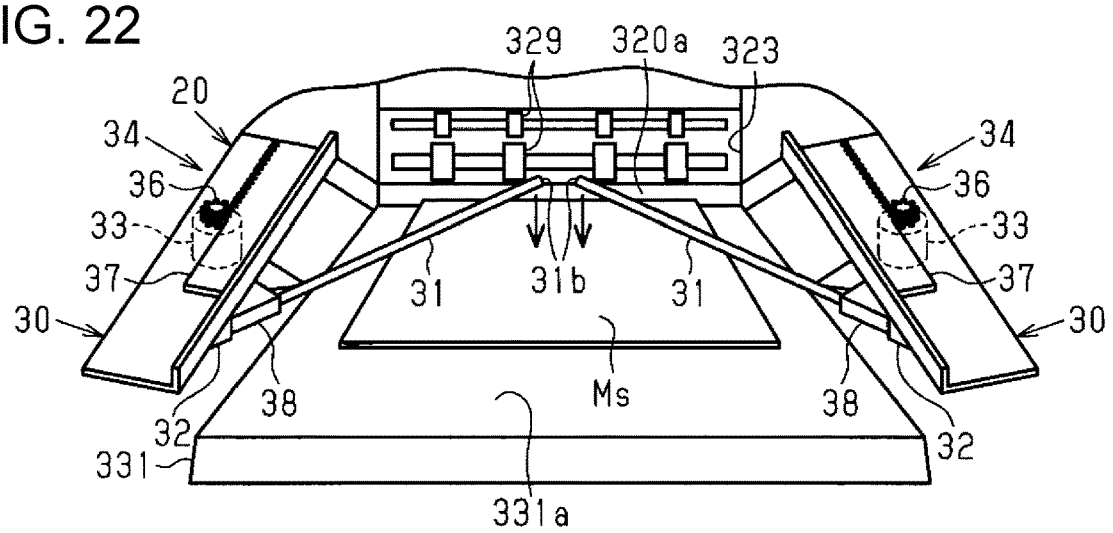
FIG. 22 is a perspective view for illustrating the operation of the folding preventing device.

As the pair of guide-movable bodies 32 pivot, the pair of guide members 31 pivot from the retracted position to the advanced position while the ends 31*a* sides on the downstream side of the discharge direction X1 are taken as the pivotal shafts 41. At this time, as illustrated in FIGS. 21 and 22, when the guide members 31 move from the retracted position to the advanced position, the other ends 31*b* sides of the guide members 31 are advanced to the inside of the discharge area EA (the discharge path) of the paper sheet M while the height position when the guide members 31 are located in the retracted position is maintained. At this time, since the pair of electric motors 33 are driven in synchronization with each other, the pair of guide members 31 pivot from the retracted position to the completely advanced position such that the other ends 31*b* approach each other toward a central side of the discharge area EA in the width direction Y.

Figure 23:
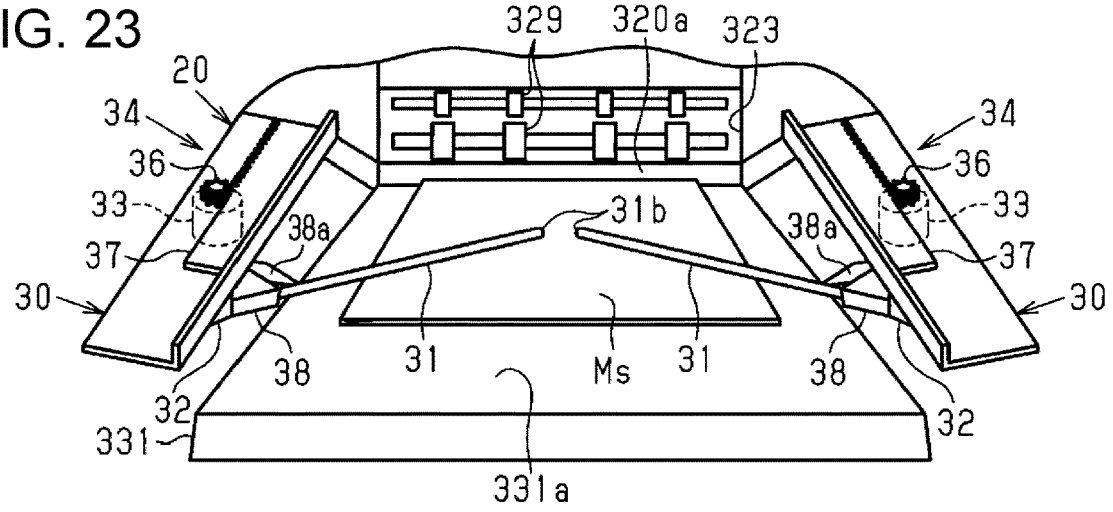
FIG. 23 is a perspective view for illustrating the operation of the folding preventing device.

The other ends 31*b* of the guide members 31 are lowered to the completely advanced position as indicated by an arrow in FIG. 22, and the guide members 31 are disposed at the advanced position as illustrated in FIG. 23. In detail, the locking mechanism 50 is unlocked at the completely advanced position of the other ends 31*b*, and the holding members 38 are tilted downward by the energization force of the energization spring 52, so that the other ends 31*b* of the guide members 31 are lowered. Thus, when the guide members 31 are disposed at the advanced position, the other ends 31*b* of the guide members 31 are disposed lower in the vertical direction Z than when the guide members 31 are disposed at the retracted position. Further, when the guide members 31 are disposed at the advanced position, the other ends 31*b* of the guide members 31 are disposed at a middle position between the discharge position by the discharge roller pair 329 and a position of an upper surface of the paper bundle M1 (the preceding paper sheet Ms) previously discharged and placed on the discharge tray 331, in the vertical direction Z. Further, when the guide members 31 are disposed at the advanced position, an inclination of the guide members 31 is larger than an inclination of the placement surface 331*a* of the discharge tray 331 (FIG. 18). However, the guide members 31 disposed at the advanced position may have the same inclination as that of the placement surface 331*a* of the discharge tray 331. Before the paper bundle M1 is discharged from the discharge roller pair 329, the pair of guide members 31 are disposed at the advanced position in advance (FIG. 6, FIG. 18, and FIG. 23).

Further, in this advancing process, as the rack members 37 move to the upstream side of the discharge direction X1, since the rack members 37 pivot about the pivotal shafts 41 while the pivotal shafts 41 on the ends 31*a* sides of the pair of guide members 31 move to the upstream side of the discharge direction X1 together with the rack members 37, the other ends 31*b* of the pair of guide members 31 move in the width direction Y substantially along the regulation wall 320*a*. As a result, when the guide members 31 are located at the advanced position, the other ends 31*b* of the guide members 31 are located on the upstream side of the discharge direction X1 from a position where a tip end of the discharged paper sheet M on the downstream side of the discharge direction X1 firstly comes into contact with the placement surface 331*a* or the upper surface of the preceding paper sheet Ms in a state in which there is no guide member 31. The guide members 31 are advanced to the advanced position before a tip end of the paper bundle M1 is discharged from the discharge roller pair 329 (FIG. 23).

Figure 24:
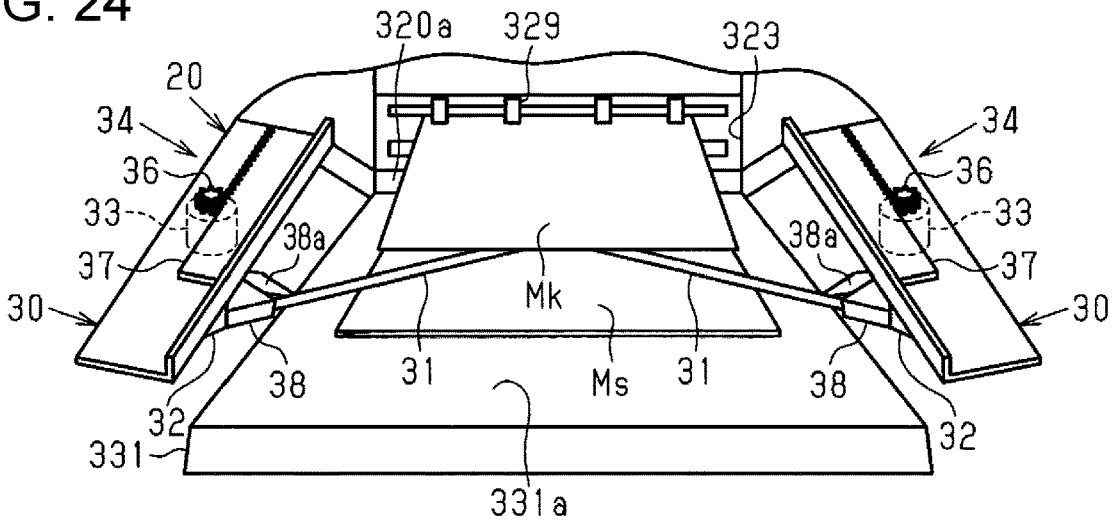
FIG. 24 is a perspective view for illustrating the operation of the folding preventing device.

As illustrated in FIG. 24, after the pair of guide members 31 are disposed at the advanced position, the following paper sheet Mk is discharged from the discharge roller pair 329. While being supported on the upper surfaces of the pair of guide members 31 disposed at the advanced position, the discharged following paper sheet Mk slides on the upper surfaces and moves obliquely upward in the discharge direction X1. At this time, since the friction coefficient of the pair of guide members with respect to the paper sheet M is equal to or less than the friction coefficient of the placement surface 331*a* with respect to the paper sheet M, the discharged following paper sheet Mk moves along the upper surfaces of the pair of guide members 31. In this way, in the discharging process, the following paper sheet Mk is supported at a position that is higher than the preceding paper sheet Ms by the pair of guide members 31 and does not come into contact with the upper surface of the preceding paper sheet Ms on the placement surface 331*a*. When the upstream end (the rear end) of the following paper sheet Mk is discharged from the discharge roller pair 329, an upstream end portion (a rear end portion) of the following paper sheet Mk in the discharge direction X1 comes into contact with the upper surface of the preceding paper sheet Ms on the placement surface 331*a*. Further, after the rear end of the following paper sheet Mk is discharged from the discharge roller pair 329, the following paper sheet Mk slides down to the upstream side of the discharge direction X1 along the upper surfaces of the guide members 31 by a self-weight thereof due to the inclination of the pair of guide members 31. As a result, the rear end of the following paper sheet Mk comes into contact with the regulation wall 320*a*, and the following paper sheet Mk is positioned in the discharge direction X1 with reference to the rear end thereof. Further, since the pair of guide members 31 are arranged in, for example, an "A" shape in which the guide members 31 are symmetric to each other with respect to a width center of the following paper sheet Mk in the width direction Y, the following paper sheet Mk receives substantially uniform sliding resistance on opposite sides of the width center from the pair of guide members 31. From this point, although the sliding resistance which the following paper sheet Mk receives from the guide members 31 is relatively small, position deviation in the width direction Y is suppressed.

In step S13 in FIG. 20, the computer 13C determines whether or not a discharge completion signal is received. When the discharge completion signal is received, the computer 13C proceeds to step S14, and when the discharge completion signal is not received, the computer 13C waits until the discharge completion signal is received. Here, the discharge completion signal is a signal serving as a trigger of starting a retracting operation of moving the guide members 31 from the advanced position to the retracted position, and is a signal obtained when the second detection unit detects the upstream end (the rear end) of the paper sheet M in the discharge direction X1. In the present example, the discharge completion signal is a signal output when the discharge detecting unit 352 (the second detection unit) detects the rear end of the paper sheet M.

Figure 25:
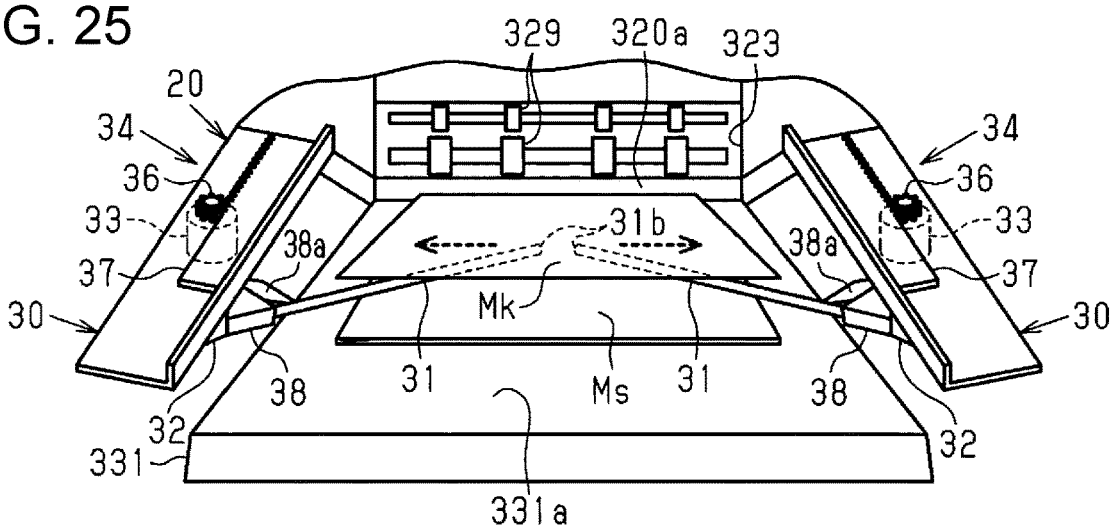
FIG. 25 is a perspective view for illustrating the operation of the folding preventing device.
Figure 26:
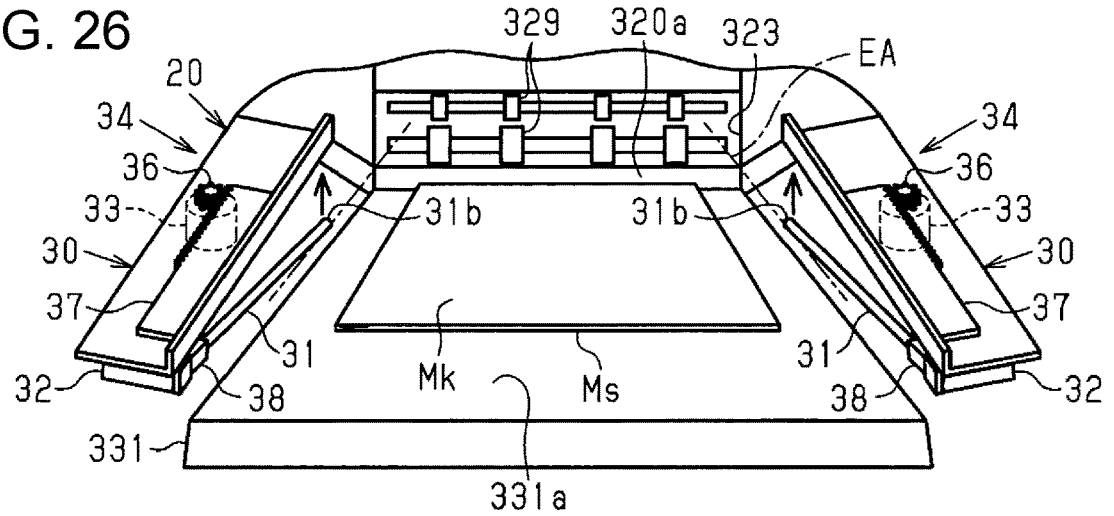
FIG. 26 is a perspective view for illustrating the operation of the folding preventing device.

In step S14, the computer 13C returns the pair of guide members 31 from the advanced position to the retracted position. In detail, the computer 13C causes the electric motors 33 to perform the reverse rotation driving, and move the pair of guide members 31 from the advanced position to the retracted position. The computer 13C starts counting after the discharge detecting unit 352 detects the paper bundle M1, and causes the electric motors 33 to perform the reverse rotation driving when a counting value reaches a predetermined value. Therefore, as illustrated in FIG. 25, after the rear end of the following paper sheet Mk is discharged from the discharge roller pair 329, the guide members 31 are retracted to the retracted position (FIG. 25 and FIG. 26).

When the guide members 31 start the retracting from the advanced position to the retracted position, an upstream side end portion (a rear end portion) of the following paper sheet Mk discharged from the discharge roller pair 329 in the discharge direction X1 comes into contact with the upper surface of the preceding paper sheet Ms. Thus, in a state in which the upstream side end portion of the paper bundle M1 in the discharge direction X1 receives a contact resistance at a position where the upstream side end portion is in contact with the upper surface of the preceding paper sheet Ms, the pair of guide members 31 moves from the advanced position to the retracted position while the ends 31*a* sides on the downstream side of the discharge direction X1 are taken as the pivotal shafts 41. When the pair of guide members 31 retract, the rack members 37 move to the downstream side of the discharge direction X1. With this movement, the pivotal shafts 41, the first guide shafts 42, and the second guide shafts 43 move to the downstream side of the discharge direction X1 along the guide grooves 35*a*, 35*b*, and 35*c*. As a result, while the guide-movable bodies 32 move to the downstream side of the discharge direction X1, the other ends 31*b* of the guide members 31 pivot about the pivotal shafts 41 toward the outside in the width direction of the discharge area EA. Further, as illustrated in FIG. 25, the guide-movable bodies 32 pivot from the advanced position to the retracted position while maintaining the low posture. That is, when the guide members 31 move from the advanced position to the retracted position, the other ends 31*b* of the guide members 31 are retracted to the outside in the width direction of the discharge direction EA while maintaining the height position when being located at the advanced position. As a result, the pair of guide members 31 can be pulled out from a lower side of the following paper sheet Mk to the outside in the width direction of the discharge area EA without causing the following paper sheet Mk to rise. Therefore, for example, the rising following paper sheet Mk is dropped onto an unspecific position in the width direction Y due to air resistance when the following paper sheet Mk is dropped. Because of this, alignment of the paper bundle M1 loaded on the placement surface 331*a* is prevented from being damaged.

When the pair of guide members 31 completely pivot to the completely retracted position, the base end portions of the holding members 38 are inserted into the reset members 48, and the holding members 38 tilt from the low posture to the high posture. As a result, as illustrated in FIG. 26, the other ends 31*b* of the guide members 31 rise at the completely retracted position as indicated by an arrow of the drawing. Accordingly, the pair of guide members 31 are disposed at the original retracted position (see FIG. 21, FIG. 5, and FIG. 8).

When the guide members 31 are disposed at the retracted position, all the ends 31*a* and the other ends 31*b* are disposed outside the discharge path of the paper sheet M in the width direction Y. The guide members 31 raise the other ends 31*b* thereof at the completely retracted position, and all the ends 31*a* and the other ends 31*b* are located outside the discharge area EA in the width direction Y. Therefore, since the guide members 31 raised at the completely retracted position do not interfere with the following paper sheet Mk, the alignment of the paper bundle M1 on the placement surface 331*a* is not damaged. As a result, the alignment of the paper bundle M1 loaded on the placement surface 331*a* of the discharge tray 331 is improved.

Further, after the pair of guide members 31 move to the retracted position while maintaining the height at the advanced position, the following paper sheet Mk is dropped onto the upper surface of the preceding paper sheet Ms on the discharge tray 331. However, the upstream end (the rear end) of the discharge direction X1 comes into contact with the regulation wall 320*a*, so that the rear end of the following paper sheet Mk is aligned.

Further, when the paper bundle M1 of the paper sheet M having a maximum width is discharged, the holding members 38 when the guide members 31 are disposed at the advanced position also guide the following paper sheet Mk on guide surfaces 38*a* together with the guide members 31. Therefore, the folding preventing device 20 can be downsized to maintain the entire length in the width direction Y relatively short. For example, if opposite end portions of the paper bundle M1 having a maximum width in the width direction Y are also guided by the pair of guide members 31, when the pair of guide units 30 are disposed on opposite sides interposing the discharge area EA, it is necessary to secure a relatively wide interval between the opposite sides in the width direction Y. Accordingly, since the paper bundle M1 having a maximum width is guided by the guide surfaces 38*a* of the holding members 38, an interval between the pair of guide units 30 in the width direction Y can be relatively narrowed, and the size of the folding preventing device 20 in the width direction Y can be reduced.

Further, in step S15 in FIG. 20, the computer 13C determines whether or not the height of an upper surface of the loaded paper sheet is appropriate. That is, the computer 13C determines whether or not the height of the upper surface of the preceding paper sheet Ms loaded on the placement surface 331*a* of the discharge tray 331 is located at an appropriate position below the guide members 31 disposed at the advanced position within a range of a predetermined distance from the discharge position of the discharge roller pair 329 such that the upper surface of the preceding paper sheet Ms is not too far from the guide member. If the height of the upper surface of the loaded paper sheet is not appropriate, the computer 13C proceeds to step S16, and if the height of the upper surface of the loaded paper sheet is appropriate, the computer 13C proceeds to step S17.

In step S16, the computer 13C moves the discharge tray. In detail, the computer 13C drives the elevation motor 335, moves the discharge tray in the vertical direction Z by a predetermined amount, and moves the discharge tray to a predetermined height in the vertical direction Z until a distance between the discharge position of the discharge roller pair 329 and the upper surface of the loaded paper sheet reaches a lower limit position within a range of a predetermined distance. In general, during the printing, the height of the paper bundle M1 loaded on the discharge tray 331 gradually increases as the discharging of the paper bundle M1 is progressed. When the loaded height becomes inappropriate, the computer 13C causes the elevation motor 335 to perform the forward rotation driving, and lowers the discharge tray 331 to an appropriate height position. Further, for example, when a user removes a part or the entirety of the paper bundle M1 from the discharge tray 331 during the printing, the computer 13C causes the elevation motor 335 to perform the reverse rotation driving and raise the discharge tray 331 to a height position at which it is determined that the height of the upper surface of the loaded paper sheet is appropriate, such that the height of the upper surface of the loaded paper sheet becomes an appropriate height.

In step S17, the computer 13C determines whether or not the printing is terminated. That is, the computer 13C determines whether or not the printing is terminated by determining whether or not the entry detecting unit 351 detects the following paper sheet M. When the printing is not terminated, that is, when there is the paper sheet M which is not discharged yet, the computer 13C returns to step S11, and repeats the processes of steps S11 to S17 until it is determined in step S17 that the printing is terminated.

In this way, unless the discharge of the following paper sheet M detected by the entry detecting unit 351 (the first detection unit) is completed, the control unit 13 causes the electric motors 33 to perform the forward rotation driving, and pivots the pair of guide members 31 from the retracted position to the advanced position. The other ends 31*b* of the guide members 31 are lowered to the completely advanced position. Thus, in a state in which the pair of guide members 31 are disposed at the advanced position, the control unit 13 waits for the next following paper sheet Mk to be discharged from the discharge roller pair 329. Hereinafter, likewise, the operations illustrated in FIGS. 21 to 26 are repeated. While being discharged from the discharge roller pair 329, the following paper sheet Mk is supported by the pair of guide members 31. In this discharging process, the following paper sheet Mk avoids sliding on the upper surface of the preceding paper sheet Ms. As a result, while the paper bundle M1 is placed on an upper surface of the preceding paper bundle M1, downward folding of the following paper bundle M1 is suppressed.

According to the first embodiment described above, the following effects can be achieved.

(1) The post-processing device 300, which is an example of a medium discharging device, includes the discharge roller pair 329 that discharges the paper bundle M1, and the discharge tray 331 that is disposed below the discharge roller pair 329 in the vertical direction Z and has the placement surface 331*a* on which the discharged paper bundle M1 is placed. The post-processing device 300 includes the guide members 31 that are provided to be advanced and retracted between the advanced position where the guide members 31 are advanced from opposite sides in the width direction Y intersecting the discharge direction X1 of the paper bundle M1 to an inner side in the width direction Y and the retracted position where the guide members 31 are retracted to end portion position sides in the width direction Y. When the guide members 31 are disposed at the advanced position, upstream side end portions in the discharge direction X1, which are portions of the guide members 31 which are advanced to the inner side in the width direction Y, are disposed between the discharge position by the discharge roller pair 329 and the position of the placement surface 331*a* of the discharge tray 331, in the vertical direction Z. Thus, the paper bundle M1 being discharged from the discharge roller pair 329 is temporarily supported and discharged by the guide members 31 which are advanced from the retracted position where the guide members 31 are disposed on the opposite sides in the width direction Y and the advanced position where the guide members 31 are disposed on the inner side in the width direction Y. Thereafter, as the guide members 31 are retracted to the retracted position, the paper bundle M1 is placed on the placement surface 331*a* or the upper surface of the preceding paper sheet Ms previously placed on the placement surface 331*a*. Therefore, folding of the discharged paper bundle M1 can be reduced.

(2) The guide members 31 can be advanced and retracted between the advanced position where the other ends 31*b* sides are advanced to a central side in the width direction Y and the retracted position where the other ends 31*b* sides are retracted to the end portion position sides in the width direction Y while the ends 31*a* sides on the downstream side of the discharge direction X1 are taken as the pivotal shafts 41. Since the guide members 31 correspond to a pivotal type in which the other ends 31*b* sides can be advanced and retracted between the advanced position and the retracted position while the ends 31*a* sides are taken as the pivotal shafts 41, for example, elongated members can be used as the guide members 31. Thus, the folding preventing device 20 can be downsized in the width direction Y, and the post-processing device 300 can be downsized in the width direction Y.

(3) When the guide members 31 are disposed at the advanced position, the other ends 31*b* sides of the guide members 31 are disposed on the lower side in the vertical direction Z than when they are disposed at the retracted position. Thus, since the guide members 31 disposed at the advanced position have an inclined posture in which the other end sides are lowered, the paper bundle M1 is guided by the guide members 31 to a posture in which a downstream end (a tip end) is higher than an upstream end (a rear end). Further, a force of a medium after discharge is suppressed by the inclination of the guide members 31. Therefore, the guide members 31 are retracted to the retracted position, and when the paper bundle M1 is placed on the upper surface of the preceding paper sheet Ms, position deviation toward the downstream side of the discharge direction X1 hardly occurs. Thus, the paper bundle M1 can be aligned and loaded on the placement surface 331*a* of the discharge tray 331 well.

(4) When the guide members 31 move from the retracted position to the advanced position, the other ends 31*b* sides of the guide members 31 are advanced to the inside of the discharge area EA of the paper bundle M1 while maintaining the height position when the guide members 31 are located at the retracted position, and are then lowered to the completely advanced position. Thus, it is easy to avoid erroneous contact with the preceding paper sheet Ms when the guide members 31 move from the retracted position to the advanced position. In particular, in the present embodiment, when the other ends 31*b* of the guide members 31 are located at the retracted position, the other ends 31*b* are located above the discharge position by the discharge roller pair 329 in the vertical direction Z, so that it is easier to avoid contact with the preceding paper sheet Ms when the guide members 31 move from the retracted position to the advanced position. As a result, it is possible to reduce a frequency with which the guide members 31 wrongly come into contact with the preceding paper sheet Ms, the alignment of the preceding paper sheet Ms is damaged, or the preceding paper sheet Ms is damaged.

(5) When the guide members 31 move from the advanced position to the retracted position, the other ends 31*b* sides of the guide members 31 are retracted to the outside of the discharge area EA of the paper bundle M1 while maintaining the height position when the guide members 31 are located at the advanced position, and are then raised to the completely retracted position. Thus, while the guide members 31 move from the advanced position to the retracted position, lifting of the paper bundle M1 supported until then can be suppressed. Thus, the paper bundle M1 can be aligned and loaded on the placement surface 331*a* well.

(6) The placement surface 331*a* and the guide members 31 disposed at the advanced position are inclined in a state in which an upstream side thereof is lower than a downstream side thereof in the discharge direction X1. When the guide members 31 are located at the advanced position, the inclination of the guide members is larger than the inclination of the placement surface 331*a*. Thus, it is easy to place the paper bundle M1 on the upper surface of the preceding paper sheet Ms collected on the upstream side of the discharge direction X1. As a result, the paper bundle M1 can be aligned and loaded on the placement surface 331*a* of the discharge tray 331 well.

(7) The friction coefficient of the guide members 31 is set less than the friction coefficient of the placement surface 331*a* of the discharge tray 331. Thus, while being discharged, the paper bundle M1 slides on the upper surfaces of the guide members 31 as easily as or more easily than the placement surface 331*a*. Therefore, the discharged paper bundle M1 slides on the upper surfaces of the guide members 31 without being caught. Thus, it is easy to avoid position deviation of the paper bundle M1, which is caused by the catching, or the like. From this point, the paper bundle M1 can be aligned and loaded on the placement surface 331*a* of the discharge tray 331 well.

(8) The guide members 31 are advanced to the advanced position before a downstream side end portion (a tip end) of the paper bundle M1 discharged from the discharge roller pair 329 in the discharge direction X1 is in contact with the upper surface of the preceding paper sheet Ms previously discharged and placed on the discharge tray 331. Thus, folding, which is generated as the tip end of the paper bundle M1 is pulled out to the downstream side of the discharge direction X1 while coming into contact with the upper surface of the preceding paper sheet Ms, can be suppressed more effectively. Further, the guide members 31 are retracted to the retracted position after an upstream side end portion (a rear end) of the paper bundle M1 in the discharge direction X1 is discharged from the discharge roller pair 329. Therefore, the guide members 31 support the paper bundle M1 at the advanced position while receiving at least a force for discharging the paper bundle M1 from the discharge roller pair 329, and are retracted from the advanced position after no longer receiving a force for discharging the paper bundle M1 from the discharge roller pair 329. Thus, the folding, which is generated as the paper bundle M1 is fed out to the downstream side of the discharge direction X1 while the tip end of the paper bundle M1 is in contact with the upper surface of the preceding paper sheet Ms, can be suppressed more effectively.

(9) In particular, in the present embodiment, the guide members 31 are advanced to the advanced position before the downstream side end portion (the tip end) of the paper bundle M1 in the discharge direction X1 is discharged from the discharge roller pair 329. Thus, contact between the guide members 31 and the discharged paper bundle M1 while the guide members 31 are advanced to the advanced position can be suppressed. Therefore, the position deviation of the paper bundle M1, which is caused by the contact between the guide members 31 and the discharged paper bundle M1 while the guide members 31 move, can be also suppressed.

(10) When the guide members 31 start to be retracted from the advanced position to the retracted position, the upstream side end portion (the rear end) of the paper bundle M1 discharged from the discharge roller pair 329 in the discharge direction X1 comes into contact with the paper bundle M1 previously discharged and placed on the discharge tray 331, that is, the upper surface of the preceding paper sheet Ms. Therefore, in a state in which the upstream side end portion of the paper bundle M1 is in contact with the upper surface of the preceding paper sheet Ms to receive a contact resistance, the guide members 31 start to be retracted from the advanced position to the retracted position. As a result, the position deviation of the paper bundle M1, which is supported on the upper surfaces of the guide members 31 when the guide members 31 retract, hardly occurs. Thus, the paper bundle M1 can be aligned and loaded on the placement surface 331*a* of the discharge tray 331 well.

(11) When the guide members 31 are disposed at the retracted position, all the ends 31*a* sides and the other ends 31*b* sides are disposed outside the discharge area EA of the paper bundle M1 in the width direction Y. For example, when the guide members 31 are retracted to the retracted position, if parts of the guide members 31 are located inside the discharge area EA, when the paper bundle M1 is caught by the parts of the guide members 31 and is dropped onto the upper surface of the preceding paper sheet Ms, the position deviation is likely to occur. In this regard, in the guide members 31, since all the ends 31*a* sides and the other ends 31*b* sides are retracted to the outside of the discharge area EA of the paper bundle M1, when the support by the guide members 31 is released so that the paper bundle M1 is dropped onto the upper surface of the preceding paper sheet Ms, the position deviation hardly occurs.

(12) When the guide members 31 are located at the advanced position, the other ends 31*b* sides of the guide members 31 are located on the upstream side of the discharge direction X1 from a position where the tip end which is the downstream side of the discharged paper bundle M1 in the discharge direction X1 firstly comes into contact with the upper surface of the paper bundle M1 (the preceding paper sheet Ms) previously discharged and placed on the discharge tray 331, in a state in which there is no guide member 31. Thus, the paper bundle M1 can be supported by the guide members 31 without bringing the tip end of the discharged paper bundle M1 into contact with the upper surface of the preceding paper sheet Ms. Thus, the folding, which is easily generated when the paper bundle M1 comes into contact with the upper surface of the preceding paper sheet Ms, can be suppressed more effectively.

(13) When the guide members 31 are located at the advanced position, the guide surfaces 38*a* of the holding members 38 guide a wide paper bundle M1 such as the paper bundle M1 having a maximum width together with the guide members 31. Thus, since the holding members 38 that hold and pivot the guide members 31 are configured to guide the paper bundle M1 together with the guide members 31, the holding members 38 are disposed inwardly close to the discharge area EA of the paper bundle M1. Thus, the post-processing device 300 can be downsized in the width direction Y as compared to a case where the folding preventing device 20 including the guide members 31 and the holding members 38 is provided.

(14) The holding members 38 that hold and pivot the guide members 31 move to the upstream side of the discharge direction X1 when the guide members 31 move to the advanced position, and move to the downstream side of the discharge direction X1 when the guide members 31 move to the retracted position. That is, the guide members 31 are advanced and retracted through a combination of the pivoting of the holding members 38 and the linear movement of the holding members 38 in parallel to the discharge direction X1. When the other ends 31*b* of the guide members 31 draw circular arcs directed toward the downstream side, the holding members 38 move to the upstream side, and when the other ends 31*b* of the guide members draw circular arcs displaced toward the upstream side, the holding members 38 move to the downstream side. Thus, while the guide members 31 move from the advanced position to the retracted position, the amount by which the positions of the other ends 31*b* of the guide members 31 are changed in the discharge direction X1 can be reduced relatively. Thus, while the guide members 31 are retracted from the advanced position, a force that is applied to the paper bundle M1 and is opposite to the discharge direction X1 can be kept relatively small. Further, when the guide members 31 correspond to a pivotal type, the other ends 31*b* of the guide members 31 draw circular air trajectories. Thus, when the guide members 31 are located at the advanced position, it is difficult to dispose the other ends 31*b* at positions close to the upstream side of the discharge direction X1. Accordingly, in the present embodiment, since the pivotal movement of the holding members 38 and the linear movement of the holding members 38 in parallel to the discharge direction X1 are combined with each other, the other ends 31*b* can be disposed at the positions close to the upstream side when the guide members 31 are disposed at the advanced position. Thus, even if the paper bundle M1 corresponds to a thin paper type in which a tip end side is easily bent downward when a paper sheet is discharged, a tip end of the paper bundle M1 can be more reliably guided by the guide members 31 without being brought into the upper surface of the preceding paper sheet Ms, so that the downward folding can be suppressed.

Second Embodiment

Next, a medium discharging device according to a second embodiment will be described with reference to FIG. 27. In this second embodiment, the folding preventing device 20, which is the same as that according to the first embodiment, is applied to the image forming device. The folding preventing device 20 guides a single paper sheet M after the printing while the paper sheet M is discharged to the placement stand 156 as an example of a placement portion, and prevents downward folding of the paper sheet M. An image forming device 400 illustrated in FIG. 27 has the same configuration as that of the image forming device 100 according to the first embodiment except that the folding preventing device 20 is provided.

Figure 27:
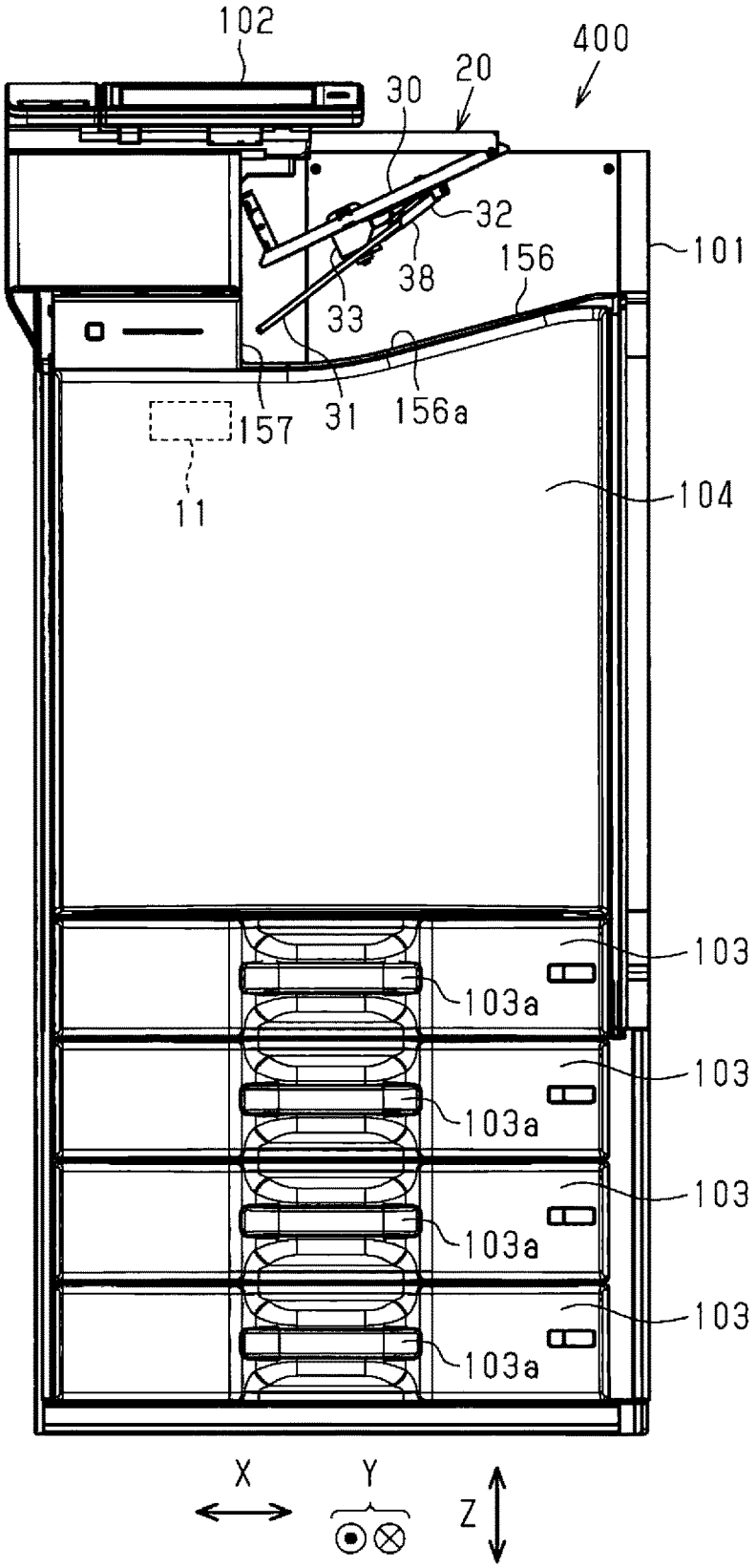
FIG. 27 is a front view illustrating an image forming device including a folding preventing device according to a second embodiment.

As illustrated in FIG. 27, in the image forming device 400 as an example of the medium discharging device, the folding preventing device 20, which is the same as that according to the first embodiment, is provided above the placement stand 156 to which the paper sheet M after the printing is discharged, in the vertical direction Z. The pair of guide members 31 of the folding preventing device 20 move between the retracted position (see FIG. 5) and the advanced position (see FIG. 6) illustrated in FIG. 27. The folding preventing device 20 guides the paper sheet M discharged from the discharge roller pair 131A (see FIG. 2) as an example of a discharge portion provided in the discharge port 155, by the pair of guide members 31 disposed in advance from the retracted position to the advanced position, before the paper sheet M is dropped onto the placement surface 156*a* of the placement stand 156 or the upper surface of the previously discharged paper sheet M (the preceding paper sheet) placed on the placement stand 156.

Further, a position condition between the guide members 31, the discharge roller pair 131A, and the placement surface 156*a* constituting the folding preventing device 20 is the same as a position condition between the guide members 31, the discharge roller pair 329, and the placement surface 331*a* in the first embodiment. For example, when the guide members 31 are disposed at the advanced position, the other ends 31*b*, which correspond to the upstream side end portions of the guide members 31 in the discharge direction X1, are disposed between a discharge position (a nip position) by the discharge roller pair 131A and a position of an upper surface of the preceding paper sheet, which is an upper surface of the paper sheet M previously discharged and placed on the placement stand 156, in the vertical direction Z. Further, like the first embodiment, the friction coefficient of the guide members 31 is equal to or less than the friction coefficient of the placement surface 156*a*, and the angle θ2 of the guide members 31 when the guide members 31 are disposed at the advanced position is larger than the angle θ1 of the placement surface 156*a*.

Further, in an electric configuration related to the folding preventing control in the image forming device 400, the control unit 13 in FIG. 19 is replaced with the control unit 11, and the entry detecting unit 351 and the discharge detecting unit 352 are replaced with the first detection unit and the second detection unit that detect the paper sheet M on the transport path in the image forming device 400. Further, the placement stand 156 can be replaced with the discharge tray that can be raised and lowered in the vertical direction Z. In this case, the control unit 11 drives and controls the elevation motor (not illustrated) based on a detection signal of the paper surface detecting unit that is the same as that according to the first embodiment, and performs elevation control of the discharge tray. The computer (not illustrated) of the control unit 11 performs a folding preventing control routine illustrated in FIG. 20. The computer of the control unit 11 causes the electric motors 33 to perform the forward rotation driving using a detection signal obtained when the first detection unit detects the paper sheet M as a trigger, and causes the electric motors 33 to perform the reverse rotation driving based on a detection signal obtained when the second detection unit detects the paper sheet M after the rear end of the paper sheet M after the printing is discharged from the discharge roller pair 131A.

The pair of guide members 31 are disposed at the advanced position before the tip end of the paper sheet M is discharged from the discharge roller pair 131A, and start retracting from the advanced position to the retracted position after the rear end of the paper sheet M is discharged from the discharge roller pair 131A. According to this embodiment, in the image forming device 400, the same effects as the effects (1) to (14) of the first embodiment can be obtained. Thus, the downward folding when a single paper sheet M printed by the image forming device 400 is discharged can be suppressed.

Figure 28:
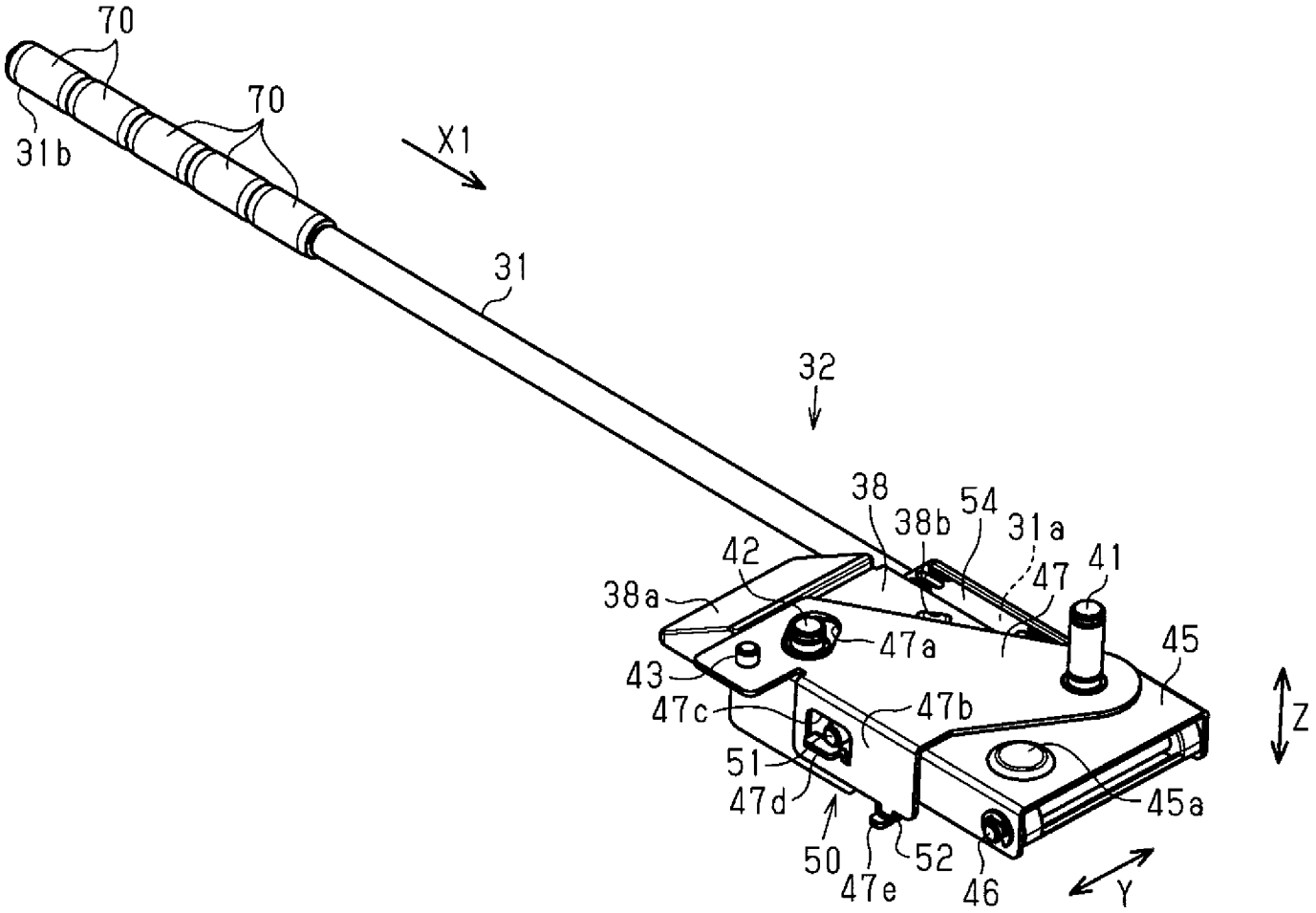
FIG. 28 is a perspective view illustrating a guide unit according to a modification.

The above-described embodiments can be changed to the following form. As illustrated in FIG. 28, rollers 70 may be provided in the guide member 31. In an example illustrated in the drawing, although the plurality of rollers 70 are provided, there may be only one roller 70. In this way, a pivoting member may be provided in the guide member 31 or the guide member 31 itself may pivot. For example, the circular columnar guide member 31 may be provided to be shaft-pivotable with respect to the holding member 38. In this way, the other end 31*b* side of the guide member 31 is a portion that is rotatable about an extending direction of the guide member 31 as a rotary axis. According to this configuration, as a medium such as the paper bundle M1 and the paper sheet M is supported on at least a part of the rotatable portion (for example, the roller 70) of the guide member 31, friction between the guide member 31 and the medium can be reduced. For example, while the guide member 31 is retracted, a damage to alignment of the medium, caused by catching by the friction between the guide member 31 and the medium, can be suppressed. Thus, the alignment of the medium in the discharge tray 331 and the placement stand 156 can be improved. A plurality of spheres are partially exposed from an outer peripheral surface of the guide member 31 at a part of the other end 31*b* side of the guide member 31 and are rotatably embedded, so that the friction resistance between the guide member 31 and the medium may be reduced.

The folding preventing device 20 provided in the post-processing device 300 may be driven and controlled based on a detection signal from a sensor (a detection unit) that detects the paper sheet M printed inside the image forming device 100. For example, the control unit 11 transmits an advance instruction signal and a retract instruction signal to the control unit 13 of the post-processing device 300, based on a detection signal indicating that the paper sheet is detected from the sensor inside the image forming device 100. The control unit 13 causes the electric motor 33 to perform the forward rotation driving based on the received advance instruction signal, and causes the electric motor 33 to perform the reverse rotation driving based on the received retract instruction signal. At least one of another detection unit (a sensor) of the image forming device 100, a detection unit of the intermediate transporting device 200 (for example, the detection unit 285), and another detection unit (a sensor) of the post-processing device 300 can be used as a transmission source for determining a driving start timing or a driving completion timing of the folding preventing device 20. Further, the first detection unit for determining the driving start timing and the second detection unit for determining the driving completion timing may be separate sensors or the same sensor.

A holding portion that holds and pivots the guide member may be configured not to guide the medium when the guide member is located at the advanced position. That is, the medium may be guided only by the guide member.

When the guide member is disposed at the retracted position, it is not always necessary that both the one end portion and the other end portion are disposed outside the discharge path of a medium having a maximum width. Both the one end portion and the other end portion may be disposed outside the discharge path of the medium corresponding to the width of the medium at that time. For example, when the guide member is disposed at the retracted position, positions where both the one end portion and the other end portion may be disposed are changed according to the width of the medium.

When the guide member starts to move from the retracted position to the advanced position, the upstream side end portion in the discharge direction X1 of the medium may be not in contact with and spaced apart from the upper surface of the preceding medium. Even in this configuration, although the alignment of the medium is somewhat damaged, the downward folding of the medium can be reduced.

The guide member may finish to be advanced to the advanced position before the downstream side end portion in the discharge direction of the medium is discharged from the discharge roller, and may start to be retracted from the retracted position before the upstream side end portion in the discharge direction of the medium is discharged from the discharge roller. Further, as long as the guide member can guide the downstream side end portion of the medium in the discharge direction, the guide member may be completely advanced to the advanced position after the downstream side end portion of the medium in the discharge direction is discharged from the discharge roller. For example, the guide member may be completely advanced to the advanced position between a time point when the downstream side end portion of the medium in the discharge direction is discharged from the discharge roller and a time point when the downstream side tip end portion comes into contact with the upper surface of the preceding medium.

The friction coefficient of the guide member 31 may be set as a larger value than the friction coefficient of the placement surfaces 331*a* and 156*a*. If a contact area between the guide member and the medium is sufficiently smaller than a contact area between the medium and the placement surface, sliding resistance between the medium and the guide member 31 may be smaller than sliding resistance between the medium and the placement surface.

When being disposed at the advanced position, the guide member 31 may have the same inclination as that of the placement surface or may have an inclination that is smaller than that of the placement surface. However, it is preferable that the guide member have an inclination that is the same as that of the placement surface or is larger than that of the placement surface.

The other end 31*b* may be lowered to the low position when the guide member 31 is located at the retracted position, the guide member 31 may move from the retracted position to the advanced position while maintaining the low position, the guide member 31 may move from the advanced position to the retracted position while the other end 31*b* is located in the low position, and the other end 31*b* may be raised to the high position when the guide member 31 is located in the completely retracted position. In short, the other end of the guide member 31 may be disposed between the discharge roller pair and the placement surface in the vertical direction Z at the advanced position, and may be maintained in the low position while the guide member 31 is retracted. Further, the following medium may be gradually lowered within a range not interfering with the preceding medium while the guide member 31 is retracted, so that a height difference when the following medium is dropped onto the upper surface of the preceding medium may be kept small.

Movement of the guide member 31 between the retracted position and the advanced position is not limited to the pivoting. For example, the guide member may correspond to a slide type in which the guide member slides in parallel to the width direction Y to move between the retracted position and the advanced position. In this case, the guide member may have a posture inclined in an "A" shape, which is like the above-described embodiment, or may have a posture that is in parallel to the discharge direction X1.

A distance (an interval) between the other ends 31*b* of the guide members 31 disposed at the advanced position in the width direction Y may be changed according to the width of the medium. The control unit 13 controls to widen the distance between the other ends 31*b* of the guide members 31 as the width of the medium becomes wider. In this case, for example, a motor for pivoting the guide member and a motor for vertical movement are provided, and the control unit controls to change a driving amount of the motor for pivoting among the two motors according to the width of the medium.

The pivotal movement of the guide member 31 is performed through a cam mechanism that guides a guide shaft along a guide groove, and similarly the vertical movement of a guide member 31 may be performed through the cam mechanism instead of the locking mechanism.

The disclosure is not limited to the pair of guide members, and one guide member or three or more guide members may be provided. Although a downstream end side of the guide member is used as a pivotal shaft, an upstream end side may be used as a pivotal shaft.

As a result of detection by the paper surface detecting unit 353, when the medium is not placed on the placement portion, the folding preventing control may not be performed.

The disclosure is not limited to a configuration in which the pair of guide members are advanced from the retracted position where the guide members are disposed at an end portion side position in the width direction to the advanced position inside the discharge path. For example, the guide members may be disposed at the retracted position on an upper side of the placement stand or may be lowered from the retracted position to be disposed at the advanced position. Further, the guide members may be disposed at the retracted position inside the frame 320 and may move to the downstream side of the discharge direction X1 from the discharge roller side to be disposed at the advanced position. Further, the guide members may move from the retracted position where the guide members are located obliquely upward in the downstream side in the discharge direction X1 with respect to the discharge tray to the upstream side to be disposed at the advanced position. In this case, when the guide members are disposed at the advanced position, it is preferable that the guide members be disposed to be line-symmetric to each other on opposite sides interposing a width center line of the medium and uniformly guide the medium on the opposite sides interposing the width center line. In this case, although one guide member may be configured, it is preferable that the pair of guide members that are individually driven be configured.

The electric motors 33, which are power sources of the guide units 30, may be stepping motors, and the positions of the guide members 31 may be detected by the number of steps. Further, the electric motors 33 may be DC motors. In the case of the DC motors, for example, an encoder that can output pulse signals, the number of which is in proportion to a moving distance of the rack member 37 may be provided and the positions of the guide members 31 may be detected by counting edges of output pulses of the encoder.

Each function unit constructed in the control unit is not limited to realization by software by a computer that executes a program, and may be realized by hardware by an electronic circuit such as a field-programmable gate array (FPGA) and an application specific IC (ASIC) or may be realized by cooperation of the software and the hardware.

The medium is not limited to paper, and may be a resin film or sheet, a composite film (a laminate film) of resin and metal, a woven fabric, a nonwoven fabric, a metal foil, a metal sheet, a ceramic sheet or the like. Further, the image forming device is not limited to a line printing type image forming device (a line printer), and may be a serial printing type imaging forming device (a serial printer). Further, the image forming device is not limited to an inkjet printer, but may be an electrophotographic printer such as a dot impact printer, a thermal transfer printer, and a laser printer. Further, the image forming device may be a multifunction machine having a scanner unit.

What is claimed is:

1. A medium discharging device for receiving a medium discharged from a discharge portion of a processing device, the device comprising:

a placement portion that is disposed below a height position of the discharge portion in a vertical direction and has a placement surface on which the discharged medium is placed; and a guide member that is provided to be advanced and retracted between an advanced position where the guide member is advanced inward in a width direction intersecting a discharge direction of the medium from opposite sides in the width direction and a retracted position where the guide member is retracted to an end portion position side in the width direction, wherein when the guide member is disposed at the advanced position, an upstream side end portion of the guide member in the discharge direction is disposed in a height position between a height position of a discharge position of the discharge portion in the vertical direction and a height position of the placement surface of the placement portion in the vertical direction, wherein in the guide member, the other end side, which corresponds to the upstream side end portion, is advanced and retracted between the advanced position and the retracted position with one end side on a downstream side of the discharge direction as a pivotal shaft, wherein a height position of the other end side of the guide member in the vertical direction when the guide member is disposed at the advanced position is lower than a height position of the other end side of the guide member in the vertical direction when the guide member is disposed at the retracted position, wherein the placement surface and the guide member disposed at the advanced position are inclined in a state in which an upstream side is lower than a downstream side in the discharge direction, and wherein when the guide member is disposed at the advanced position, an inclination of the guide member is larger than an inclination of the placement surface.

2. The medium discharging device according to claim 1, wherein when the guide member moves from the retracted position to the advanced position, the other end side of the guide member is advanced to an inside of a discharge path of the medium, which is an inside in the width direction, while maintaining a height position when the guide member is located at the retracted position, and is lowered at a completely advanced position.

3. The medium discharging device according to claim 1, wherein when the guide member moves from the advanced position to the retracted position, the other end side of the guide member is retracted to an outside of a discharge path of the medium, which is an end portion position in the width direction, while maintaining a height position when the guide member is disposed at the advanced position, and is raised at a completely retracted position.

4. The medium discharging device according to claim 1, wherein a friction coefficient of the guide member is set to be equal to or lower than a friction coefficient of the placement surface of the placement portion.

5. The medium discharging device according to claim 1, wherein the guide member is advanced to the advanced position before a downstream side end portion of the medium discharged from the discharge portion in the discharge direction comes into contact with an upper surface of the medium previously discharged and is placed on the placement portion, and is retracted to the retracted position after an upstream side end portion of the medium in the discharge direction is discharged from the discharge portion.

6. The medium discharging device according to claim 5, wherein the guide member is advanced to the advanced position before the downstream side end portion of the medium in the discharge direction is discharged from the discharge portion.

7. The medium discharging device according to claim 1, wherein when the guide member starts to be retracted from the advanced position to the retracted position, the upstream side end portion of the medium discharged from the discharge portion in the discharge direction comes into contact with an upper surface of the medium previously discharged and placed on the placement portion.

8. The medium discharging device according to claim 1, wherein when the guide member is disposed at the retracted position, both one end side and the other end side of the guide member in the discharge direction are disposed outside a discharge path of the medium in the width direction.

9. The medium discharging device according to claim 1, wherein when the guide member is located at the advanced position, an upstream end side of a portion of the guide member, which is advanced inward in the width direction, is disposed upstream in the discharge direction from a position where a tip end of the discharged medium on a downstream side in the discharge direction would first come into contact with an upper surface of the medium previously discharged and placed on the placement portion in a state in which there were no guide member.

10. The medium discharging device according to claim 1, further comprising:

a holding portion that holds and pivots the guide member, wherein when the guide member is located at the advanced position, the holding portion also guides the medium together with the guide member.

11. The medium discharging device according to claim 10, wherein the holding portion moves upstream in the discharge direction when the guide member moves to the advanced position, and moves downstream in the discharge direction when the guide member moves to the retracted position.

12. The medium discharging device according to claim 1, wherein a portion that is rotatable about an extending direction of the guide member as a rotary axis exists in a portion of the guide member, which is advanced inward in the width direction.

13. A method of controlling a medium discharging device for receiving a medium discharged from a discharge portion of a processing device, the medium discharging device including a placement portion that is disposed below a height position of the discharge portion in a vertical direction and has a placement surface on which the discharged medium is placed, and a guide member that is provided to be retracted and advanced between a retracted position where the guide member is retracted to an end portion position side in the width direction intersecting a discharge direction of the medium and an advanced position where the guide member is advanced inward in the width direction, when the guide member is disposed at the advanced position with one end side on a downstream side of the discharge direction as a pivotal shaft, a height position of an upstream side end portion of the guide member in the discharge direction in the vertical direction is lower than the retracted position, the method comprising:

disposing the guide member at the advanced position before a downstream side end portion of the medium in a transport direction is discharged, and disposing an upstream side end portion of the guide member in the discharge direction between a height position of a discharge position discharged by the discharge portion in the vertical direction and a height position of the placement surface of the placement portion in the vertical direction;

receiving the medium discharged by the guide member while supporting the downstream side end portion of the discharged medium in the transport direction; and disposing the medium in the placement portion by retracting the guide member to the retracted position after an upstream side end portion of the medium in the transport direction is discharged in a state in which the downstream side end portion of the medium in the transport direction is supported by the guide member.

14. A medium discharging device for receiving a medium discharged from a discharge portion of a processing device, the device comprising:

a placement portion that is disposed below a height position of the discharge portion in a vertical direction and has a placement surface on which the discharged medium is placed; and a guide member that is provided to be advanced and retracted between an advanced position where the guide member is advanced inward in a width direction intersecting a discharge direction of the medium from opposite sides in the width direction and a retracted position where the guide member is retracted to an end portion position side in the width direction, wherein when the guide member is disposed at the advanced position, an upstream side end portion of the guide member in the discharge direction is disposed in a height position between a height position of a discharge position of the discharge portion in the vertical direction and a height position of the placement surface of the placement portion in the vertical direction, wherein in the guide member, the other end side, which corresponds to the upstream side end portion, is advanced and retracted between the advanced position and the retracted position with one end side on a downstream side of the discharge direction as a pivotal shaft, wherein a height position of the other end side of the guide member in the vertical direction when the guide member is disposed at the advanced position is lower than a height position of the other end side of the guide member in the vertical direction when the guide member is disposed at the retracted position, and wherein when the guide member moves from the retracted position to the advanced position, the other end side of the guide member is advanced to an inside of a discharge path of the medium, which is an inside in the width direction, while maintaining a height position when the guide member is located at the retracted position, and is lowered at a completely advanced position.

15. A medium discharging device for receiving a medium discharged from a discharge portion of a processing device, the device comprising:

a placement portion that is disposed below a height position of the discharge portion in a vertical direction and has a placement surface on which the discharged medium is placed; and a guide member that is provided to be advanced and retracted between an advanced position where the guide member is advanced inward in a width direction intersecting a discharge direction of the medium from opposite sides in the width direction and a retracted position where the guide member is retracted to an end portion position side in the width direction, wherein when the guide member is disposed at the advanced position, an upstream side end portion of the guide member in the discharge direction is disposed in a height position between a height position of a discharge position of the discharge portion in the vertical direction and a height position of the placement surface of the placement portion in the vertical direction, wherein in the guide member, the other end side, which corresponds to the upstream side end portion, is advanced and retracted between the advanced position and the retracted position with one end side on a downstream side of the discharge direction as a pivotal shaft, wherein a height position of the other end side of the guide member in the vertical direction when the guide member is disposed at the advanced position is lower than a height position of the other end side of the guide member in the vertical direction when the guide member is disposed at the retracted position, and wherein when the guide member starts to be retracted from the advanced position to the retracted position, the upstream side end portion of the medium discharged from the discharge portion in the discharge direction comes into contact with an upper surface of the medium previously discharged and placed on the placement portion.

* * * * *